US008323156B2

(12) United States Patent
Ozawa et al.

(10) Patent No.: US 8,323,156 B2
(45) Date of Patent: Dec. 4, 2012

(54) LEG TRAINING EQUIPMENT

(75) Inventors: Takahisa Ozawa, Neyagawa (JP); Youichi Shinomiya, Ibaraki (JP); Kazuhiro Ochi, Osaka (JP); Yuritsugu Toyomi, Hikone (JP); Kouichi Ishino, Hikone (JP); Minoru Kawamoto, Hikone (JP)

(73) Assignee: Panasonic Corporation, Osaka (JP)

( * ) Notice: Subject to any disclaimer, the term of this patent is extended or adjusted under 35 U.S.C. 154(b) by 1189 days.

(21) Appl. No.: 10/557,401

(22) PCT Filed: May 21, 2004

(86) PCT No.: PCT/JP2004/007344

§ 371 (c)(1),
(2), (4) Date: Nov. 18, 2005

(87) PCT Pub. No.: WO2004/110568

PCT Pub. Date: Dec. 23, 2004

(65) Prior Publication Data

US 2006/0229170 A1 Oct. 12, 2006

(30) Foreign Application Priority Data

May 21, 2003 (JP) ..... 2003-144013

(51) Int. Cl.
*A63B 23/04* (2006.01)
*A63B 21/068* (2006.01)

(52) U.S. Cl. ..... 482/95; 482/51; 482/79; 482/142; 601/26; 601/35

(58) Field of Classification Search ..... 482/69, 482/95, 51, 79, 142; 601/24, 26, 34, 35, 601/23, 29, 33, 36
See application file for complete search history.

(56) References Cited

U.S. PATENT DOCUMENTS 3,480 A * 3/1844 Halsted ..... 601/90
(Continued)

FOREIGN PATENT DOCUMENTS

FR 2 769 510 A1 4/1999
(Continued)

OTHER PUBLICATIONS

Supplementary European Search Report for the Application No. EP 04 74 5385 dated Jul. 11, 2008.

(Continued)

*Primary Examiner* — Loan Thanh
*Assistant Examiner* — Victor K Hwang
(74) *Attorney, Agent, or Firm* — Cheng Law Group, PLLC

(57) ABSTRACT

A leg training equipment has a base fixed in place, a support portion configured to support a part of a user's body, and a coupling mechanism provided between the base and the support portion. The coupling mechanism movably couples the support portion to the base such that a load applied to a leg of the user by the user's own weight changes by a relative positional displacement between a foot position and a position of center of gravity of the user. In addition, the coupling mechanism limits a movable direction of the support portion such that at least when the load applied to the leg increases, a direction of the relative positional displacement between the foot position and the position of center of gravity is substantially limited to a direction of flexion and extension of knee joint. Thereby, it is possible to efficiently provide the user with an exercise that applies less load on the knee joint.

30 Claims, 15 Drawing Sheets

U.S. PATENT DOCUMENTS

| | | | | | |
|---|---|---|---|---|---|
| 219,439 | A | * | 9/1879 | Blend | 601/23 |
| 1,470,403 | A | * | 10/1923 | Thalken | 482/128 |
| 2,093,830 | A | * | 9/1937 | Flatley | 601/29 |
| RE22,105 | E | * | 6/1942 | Marlower | 601/26 |
| 2,320,489 | A | * | 6/1943 | Turner et al. | 601/36 |
| 2,550,841 | A | * | 5/1951 | Martinez | 601/26 |
| 2,826,192 | A | * | 3/1958 | Mangas | 601/26 |
| 2,892,455 | A | * | 6/1959 | Hutton | 601/31 |
| 2,915,055 | A | * | 12/1959 | Matton | 601/24 |
| 2,949,911 | A | * | 8/1960 | Kennard et al. | 601/26 |
| 3,662,747 | A | * | 5/1972 | Williams | 601/5 |
| 4,130,263 | A | | 12/1978 | Roericht | |
| 4,705,028 | A | * | 11/1987 | Melby | 482/51 |
| 5,016,869 | A | | 5/1991 | Dick et al. | |
| 5,031,898 | A | | 7/1991 | Anthony | |
| 5,040,522 | A | * | 8/1991 | Daniels | 601/24 |
| 5,044,587 | A | | 9/1991 | Degen | |
| 5,419,752 | A | | 5/1995 | James et al. | |
| 5,529,573 | A | | 6/1996 | Kelly et al. | |
| 5,916,065 | A | * | 6/1999 | McBride et al. | 482/57 |
| 6,244,987 | B1 | | 6/2001 | Ohsuga et al. | |
| 6,558,304 | B1 | | 5/2003 | Bardon et al. | |
| 6,908,416 | B2 | * | 6/2005 | Mercado et al. | 482/52 |
| 2004/0097330 | A1 | * | 5/2004 | Edgerton et al. | 482/1 |

FOREIGN PATENT DOCUMENTS

| | | | |
|---|---|---|---|
| GB | 2 352 627 | A | 2/2001 |
| JP | 05-329226 | | 12/1993 |
| JP | 11-155836 | | 6/1999 |
| JP | 2002-200193 | | 7/2002 |
| JP | 2003-062020 | | 3/2003 |
| WO | WO-91/00755 | | 1/1991 |
| WO | WO-03/024538 | A1 | 3/2003 |

OTHER PUBLICATIONS

International Search Report.

* cited by examiner

LEG TRAINING EQUIPMENT

TECHNICAL FIELD

The present invention relates to an equipment, which can be used by a user having knee pain to efficiently train leg muscles, and also preferable for the purpose of beauty exercises or overcoming physical laziness.

BACKGROUND FIELD

In the past, stationary cycling machines (indoor exercise bike) and stationary running machines (treadmill) have been well known as exercise assist devices for allowing a user to voluntarily train leg muscles. On the other hand, as another exercise assist devices for providing a passive exercise to the user without the user's voluntary action, horse-riding exercise machines (e.g., Japanese Patent Publication [kokai] No. 11-155836) have been proposed.

When using the indoor exercise bike or the treadmill, there is a case that knee flexion and extension exercises are excessively provided, or a load larger than the user's own weight is applied to the knee joint. However, these are not appropriate for the user having knee pain. On the other hand, when using the conventional horse-riding exercise machines, the load applied to the knee joint is relatively small because the user sits on a seat during the exercise. However, since their purpose is to cause a muscle contraction mainly at the trunk of the body such as a lumbar portion of back, it is not necessarily enough to effectively cause leg muscle contraction.

By the way, to prevent lifestyle-related diseases that tend to rapidly increase in recent years, it is effective to reduce body fat by aerobic exercise. In addition, when sugar metabolism is enhanced by actively causing the muscle contraction to improve insulin sensitivity, it contributes to prevent the lifestyle-related diseases. To enhance the sugar metabolism by the muscle contraction, it is effective to cause the muscle contraction at a femoral region having large volume muscles. On the other hand, since diabetic patients often have knee pain, they cannot perform exercises such as squat exercise for effectively causing the muscle contraction at the femoral region. In addition, even when they perform a light exercise such as walking, there is a potential for causing clinical deterioration or an increase in knee pain. Thus, the persons who cannot perform the exercises have strong desire to exercise.

Under the circumstances, it is expected to develop equipment for efficiently training leg muscles, while minimizing the load applied to the knee.

SUMMARY OF THE INVENTION

In view of the above problems, a primary concern of the present invention is to provide a leg training equipment for allowing a user having knee pain to perform an exercise for causing a muscle contraction at a femoral region, thereby effectively contributing to lifestyle-related diseases prevention.

That is, the leg training equipment of the present invention is characterized by including a base fixed in place, a support portion configured to support a part of the user's body such that at least a part of the user's own weight acts on a leg including the femoral region, and a coupling mechanism configured to movably couple the support portion to the base such that a load applied to the leg by the user's own weight changes by a relative positional displacement between a foot position and a position of center of gravity of the user, and configured to limit a movable direction of the support portion such that at least when the load applied to the leg increases, a direction of the relative positional displacement between the foot position and the position of center of gravity is substantially limited to direction of flexion and extension of knee joint.

According to the invention, it is possible to apply a relatively light load to muscles of the leg including the femoral region of the user in a state that the part of the user's body is supported by the support portion. That is, since the relatively light load applied to the user enhances the muscle contraction at the femoral portion, which is effective for sugar metabolism, it is possible to provide appropriate leg training to the user who shows a reduction in exercise capacity due to arthritic pain and deterioration in muscle strength. In addition, by continuously using this training equipment, it is expected to prevent and improve the lifestyle-related diseases. Furthermore, in the present invention, the direction of the relative positional displacement between the foot position and the position of center of gravity of the user is substantially limited to the direction of flexion and extension of knee joint. This means that a direction of applying the load can be limited in a direction of connecting the center of knee and the second toe. When the load is applied in such a direction, the training for causing the muscle contraction of the leg can be safely provided to the user having knee pain such as osteoarthritis of the knee joint without causing clinical deterioration or knee pain. As the support portion movably coupled to the base, it is possible to adopt any one of a footplate on which the user's foot is placed, a support means configured to support the user in a sitting posture, or a support means configured to support the user in a hanging posture. In addition, it is preferred that the coupling mechanism limits the movable direction of the support portion such that a distance between the foot position and a hip position of the user of the user is kept substantially constant.

In the leg training equipment described above, when the support portion is provided by the footplate, it is preferred that the footplate is coupled to the base through the coupling mechanism so as to be movable relative to the base in at least one of horizontal and vertical directions.

In the above leg training equipment, when the support portion is provided by the support means configured to support the user in the sitting posture, it is preferred that the support means comprises a seat member configured to support a hip of the user, and movably coupled in an oscillating manner to the base through the coupling mechanism. In this case, the oscillating motion of the seat member can be obtained in a state that the part of the user's body weight is supported by riding the user's hip on the seat member, so that the load applied to the leg including the femoral region of the user enhances the muscle contraction. In addition, it is preferred to use a drive unit configured to move the seat member in the oscillating manner. By controlling a magnitude of the load applied to the user's leg in a passive manner without the user's voluntary action, the muscle contraction can be enhanced. Therefore, it is easy for the user having a disturbance in gait due to deterioration in muscle strength, or needing a rehabilitation exercise to perform the leg training. In addition, since the drive unit has a guiding role in the case of repeating the same exercise, the training can be enjoyably carried out with a sense of amusement.

In the above leg training equipment, it is preferred that the support portion has a seat member configured to support the user's hip and movably coupled in the oscillating manner to the base through the coupling mechanism, and a footplate on which the user's foot is placed, and that the footplate is movable in synchronization with the oscillating motion of the seat member by an interlock unit. In this case, the position of the footplate can be changed in response to the oscillating motion of the seat member so as to prevent a change in knee bending angle. That is, since an exercise substantially equal to isometric contraction becomes possible, damages caused to the knee by the flexion and extension of the knee joint can be reduced. Thus, the muscle contraction is obtained without the flexion and extension of the knee joint. Therefore, even when the user has knee pain derived from osteoarthritis of the knee joint, the leg training can be safely performed. In addition, it is particularly preferred that the leg training equipment has a first drive unit configured to move the seat member in the oscillating manner, a second drive unit configured to move the footplate, and a control unit configured to control the first drive unit and the second drive unit in a synchronous manner. By appropriately adjusting the relation between the first and second drive units, the load applied to the user's leg can be changed to provide the leg training without substantially changing the bending angle of the knee joint. Therefore, the muscle contraction of the femoral region can be effectively enhanced by changing the load applied to the leg in accordance with the user's need.

In addition, it is preferred that the seat member has a post coupled to the base through the coupling mechanism, a saddle disposed at a top end of the post to support the user's hip, and a joining means configured to join the saddle to the post to provide at least one of a parallel movement and a rotational movement of the saddle relative to the post. In this case, since the movement of the saddle is provided in addition to the oscillating motion of the seat member, a change in the position of center of gravity of the user becomes larger. For example, when the post is inclined and the saddle is moved, the load applied to the user's leg further increases due to a larger displacement of the position of center of gravity of the user. Alternatively, the saddle may be movable in the direction of decreasing the load applied to the user's leg.

To obtain the rotational movement of the saddle, it is preferred that the joining means movably supports the saddle to the post in a seesaw fashion. To obtain the parallel movement of the saddle, it is preferred that the joining means slidably supports the saddle in a plane intersecting an axial direction of the post. In this case, it is particularly preferred that the leg training equipment has a saddle drive unit configured to provide a slide movement of the saddle relative to the post.

In the leg training equipment using the seat member, it is preferred that the post is retractable in its longitudinal direction, and the leg training equipment has a post drive unit configured to provide extension and contraction of the post. In this case, since the bending angle of the knee joint changes in accordance with the extension and contraction of the post, it is possible to adjust the magnitude of the load applied to the user's leg. In addition, the position of the user's hip can be appropriately adjusted depending on the user's leg length.

According to another preferred embodiment of the leg training equipment of the present invention, the post is retractable in its longitudinal direction, and the leg training equipment has a footplate on which the user's foot is placed, and a control unit configured to control a first drive unit configured to move the seat member in an oscillating manner in synchronous with at least one of a second drive unit configured to drive the footplate, a third drive unit configured to provide extension and contraction of the post, and a fourth drive unit configured to provide a slide movement of the saddle in a plane intersecting an axial direction of the post. In this case, by combining the first drive unit with at least one of the second to fourth drive units, it is possible to increase a degree of freedom of design of exercise program, and provide various kinds of leg trainings according to the user's needs.

In the above leg training equipment, it is preferred that the interlock unit provides the motion of the footplate in synchronization with the oscillating motion of the seat member such that a bending angle of the knee joint of the user is in a range of 45 degrees or less when the position of center of gravity of the user is changed under a condition that the user sits on the seat member and places the foot on the footplate. In this case, even when the user has knee pain such as osteoarthritis of the knee joint, the leg training equipment can be used without causing clinical deterioration or knee pain. Alternatively, it is preferred that the interlock unit provides the motion of the footplate in synchronization with the oscillating motion of the seat member such that the bending angle of the knee joint of the user is kept substantially constant when the position of center of gravity of the user is changed.

In the above leg training equipment, it is also preferred that the interlock unit selectively provides a first exercise mode where the motion of the footplate is provided in synchronization with the oscillating motion of the seat member such that the bending angle of the knee joint of the user is in the range of 45 degrees or less when the position of center of gravity of the user is changed under a condition that the user sits on the seat member and places the foot on the footplate, and a second exercise mode where the motion of the footplate is provided in synchronization with the oscillating motion of the seat member such that the bending angle of the knee joint of the user is kept substantially constant when the position of center of gravity of the user is changed, and the leg training equipment has a selector configured to select one of the first exercise mode and the second exercise mode.

In addition, it is preferred that the leg training equipment has a measurement unit configured to measure a physiological measurement value concerning metabolism, an evaluation unit configured to determine the metabolism from an output of the measurement unit, a load applying unit configured to apply a load to the user, and a control unit configured to control a magnitude of the load to be applied to the user by the load applying unit according to the metabolism provided from the evaluation unit. In this case, it is further preferred that the evaluation unit assigns weights to the physiological measurement value by use of a weighting factor, which is one of a volume of muscles for an exercise provided by the load applying unit and a volume of red muscles for the exercise, thereby obtaining a weighted physiological measurement value as the metabolism.

Additionally, it is preferred that the leg training equipment of the present invention has a load sensor provided on the support portion to detect a load applied to the leg relative to the user's own weight, and a load-change informing unit configured to inform a change of the load detected by the load sensor with respect to time to the user in a real-time manner. In this case, since the change of the load applied to the user's leg with respect to time is indicated to the user in the real-time manner, it is possible to easily check as to whether an appropriate load is being applied to the user. When there is excess and deficiency of the load, the user can perform the exercise under the appropriate load by regulating the equipment or displacing the position of the user's body.

In addition, it is preferred that the leg training equipment has an input unit configured to input data of the user, a calculation unit configured to calculate an appropriate range of a pressure to be applied to the support portion by the user according to the data input from the input unit, a pressure sensor configured to detect a pressure actually applied to the support portion by the user, and a display unit configured to indicate the appropriate range provided by the calculation unit and the actual pressure detected by the pressure sensor to the user. According to this invention, since the display unit provides the appropriate range of the load determined by use of data peculiar to the user such as body weight, age, gender, presence or absence of disease, disease name and clinical records, the user can perform the leg training, while understanding the load range best-suited to the individual user.

In addition, it is preferred that the leg training equipment has an input unit configured to input data of the user, a calculation unit configured to calculate an appropriate range of a pressure to be applied to the support portion by the user according to the data input from the input unit, a pressure sensor configured to detect a pressure actually applied to the support portion by the user, and a control unit configured to control the coupling mechanism in a feedback manner such that the pressure detected by the pressure sensor is kept within the appropriate range. According to this invention, since a target range is determined by use of parameters such as body weight, age, gender, presence or absence of disease, disease name and clinical records, the load suitable to the user can be applied. In particular, when the user's body weight is used as the parameter to be input, and the target range is determined according to a ratio of the load applied to the leg (mainly the femoral region) relative to the user's body weight, which is calculated from the pressure value detected by the pressure sensor, it is possible to obtain an appropriate target range regardless of individual differences of the user's body weight. In addition, the safety of the leg training equipment can be improved by the feedback control.

In the leg training equipment, it is preferred that the support means has a body holding unit configured to hold the user's body in the hanging posture, and movably coupled in an oscillating manner to the base through the coupling mechanism, and a footplate on which the user's foot is placed, and that the leg training equipment further has an interlock unit configured to provide a motion of the footplate in synchronization with the oscillating motion of the body supporting unit. In particular, it is preferred that the body holding unit is provided with a waist holding member configured to hold the user' waist, and a hanging member for the user configured to be retractable in its axial direction. This is useful when it is needed to perform the leg training in a state that the user's hip does not contact the seat member.

In addition, it is preferred that the leg training equipment has a drive unit configured to move the body holding unit in an oscillating manner. In particular, it is preferred that the leg training equipment has a first drive unit configured to move the body holding unit in the oscillating manner, a second drive unit configured to move the footplate, and a control unit configured to control the first drive unit and the second drive unit in a synchronous manner.

Further characteristics of the present invention and advantages brought thereby will become more apparent from the best mode for carrying out the invention described below.

BEST MODE FOR CARRYING OUT THE INVENTION

A leg training equipment of the present invention is explained in detail according to preferred embodiments.

First Embodiment

Figure 1:
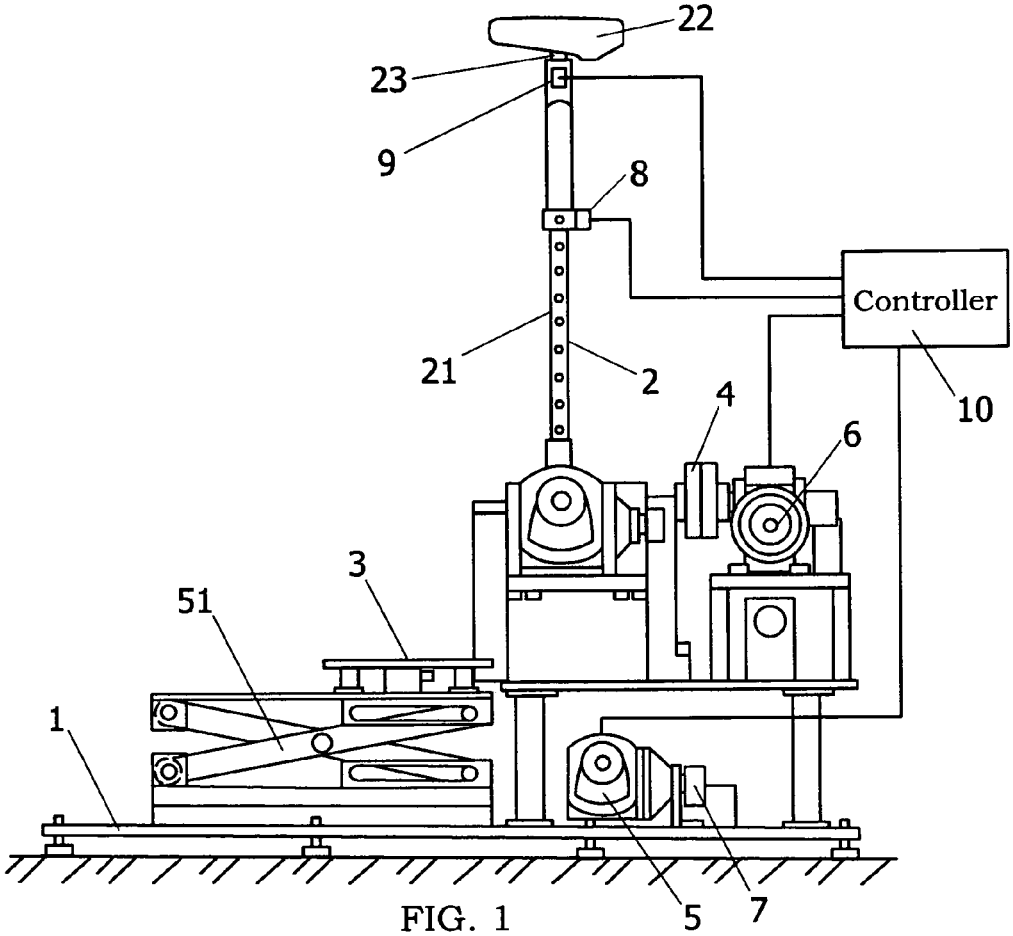
FIG. 1 is a schematic diagram of a leg training equipment according to a first embodiment of the present invention.

As shown in FIG. 1, the leg training equipment of this embodiment has a base 1 fixed on a floor surface, a seat member 2 for supporting a hip of a user, and a pair of footplates 3, on which the user's feet are placed. The seat member 2 and the footplates 3 are mounted on the base 1 through a coupling mechanism 4, 5. Motors 6, 7 are respectively connected as drive units to the coupling mechanisms 4, 5, and controlled by a controller 10. The motor 7 is provided to each of the footplates 3.

The seat member 2 is provided with a post 21, a saddle disposed at the top end of the post 21 to support the user's hip, and a joint portion 23 for joining the saddle with the post to provide parallel and rotational movements of the saddle relative to the post. The saddle is configured in such a triangular shape that its forward end portion (front side of the user sitting on the saddle 22) has a narrower width than the rearward end portion in a top plan view. The saddle 22 may be configured in another shape such as chair type or horseback type. A bottom end of the post 21 is coupled to the coupling mechanism 4.

In this embodiment, the coupling mechanism 4 has rotational shafts extending in a forward and backward direction and a left and right direction. For example, the post 21 is pivotally movable in the forward and backward direction about the rotational shaft extending in the left and right direction, and a joint including the rotational shaft extending in the left and right direction is pivotally movable in the left and right direction about the rotational shaft extending in the forward and backward direction. Therefore, according to this coupling mechanism 4, a bottom end of the post 21 works as fulcrum, the post 21 can be moved back and forth and around in an oscillating manner. In this embodiment, the coupling mechanism 4 provides the oscillating motion of the post 21 in an optional direction by use of two motors 6.

The post 21 is retractably formed in a nested structure with a bottom end portion and a top end portion. The numeral 8 designates a motor provided as a drive unit at an intermediate portion in the longitudinal direction of the post 21. A rotation of this motor 8 presents extension and contraction of the post 21. In addition, the numeral 9 designates a motor provided as the drive unit at the joint portion 23 between the post 21 and the saddle 22. This motor 9 enables an oscillating motion of the saddle 22 relative to the post 21 in the forward and backward direction.

The coupling mechanism 5 for the footplates 3 has pantographs 51 disposed on the base 1, and the footplates 3 are mounted on the pantographs 51. The motors 7 provided as the drive units in the coupling mechanism 5 enables an up and down movement of the footplates 3 through extension and contraction of the pantographs 51.

In brief, the seat member 2 can be moved back and forth and around in the oscillating manner by the motor 6. The up and down movement of the footplate 3 can be obtained by the motor 7. The extension and contraction of the post 21 can be obtained by the motor 8. The motor 9 enables an angular adjustment of the saddle 23 relative to the post 21 in the forward and backward direction. By respectively using two motors 6 for the seat member 2, and two motors 7 for the footplates 3, the total of six motors 6 to 9 are controlled to obtain a combination of the above-described motions. As described before, each of the motors 6 to 9 is controlled by the controller 10 having a microcomputer as the main component. In the controller 10, a plurality sets of time-series data for rotational angle of each of the motors 6 to 9 are installed to obtain an appropriate load for exercises. Therefore, by selecting an adequate set of time-series data, a desired operation is achieved.

The motors 6 to 9 are selectively driven in accordance with the kind of leg training to be provided to the user. Basically, the motor 6 is always driven to provide the oscillating motion of the seat member 2. when the other motors 7~9 are not used, only the oscillating motion of the seat member 2 is provided. As described later, it is preferred to drive at least one of the motors 7 for moving the footplates 3 and the motor 9 for moving the saddle 22 in synchronization with the motor 6 for moving the seat member 2.

Next, a method of using the above-described leg training equipment is explained. First, the user sits on the saddle 22, and places the feet on the footplates 3. A positional relation between the footplates 3 and the saddle 22 can be changed depending on the leg length of the user by adjusting at least one of heights of the footplates 3 and the length of the post 21.

When the oscillating motion of the seat member 2 is provided by the user sitting on the saddle 22, the position of center of gravity of the user is displaced relative to the foot position of the user. The center of gravity of the user sitting on the seat member 2 is located at a slightly forward position of the user's hip. When the seat member 2 is inclined forward from an upright position, the position of center of gravity of the user is displaced forward, so that a ratio of the load applied to the user's leg including the femoral region relative to the user's own weight increases. In addition, when the seat member 2 is inclined in the left and right direction of the user, the load is mainly applied to one leg at the inclined side of the seat member 2 by the user's own weight. Thus, since the saddle 22 receives a part of the user's own weight, and the load applied to the leg (particularly, the femoral region having a relatively large volume of muscles) is changed by the oscillating motion of the seat member 2, it is possible to efficiently realize muscle metabolism.

In the leg training equipment of this embodiment, as described above, the leg training is performed in a state that the user sits on the saddle 22 and places the feet on the footplates 3. Alternatively, the leg training may be performed in a state that the user places only one foot on the corresponding footplate 3 without sitting on the saddle 22.

Figure 2A:
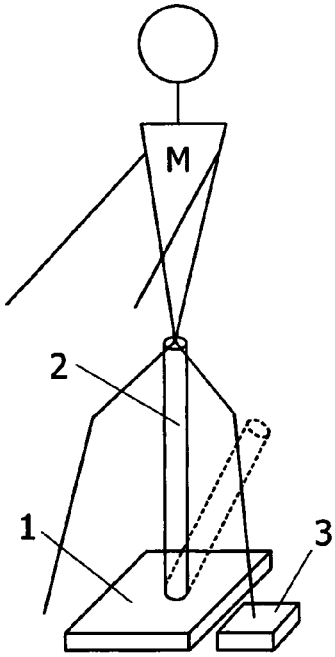
FIGS. 2A to 2C are explanatory views showing an operation of the leg training equipment.
Figure 2B:
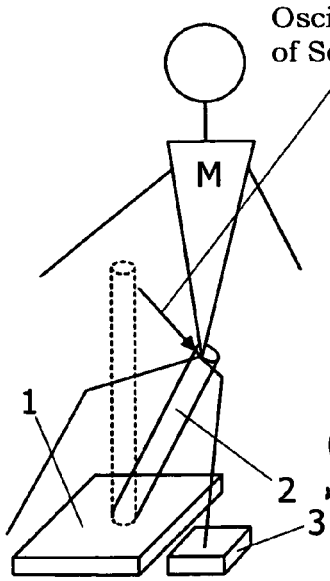
Figure 2C:
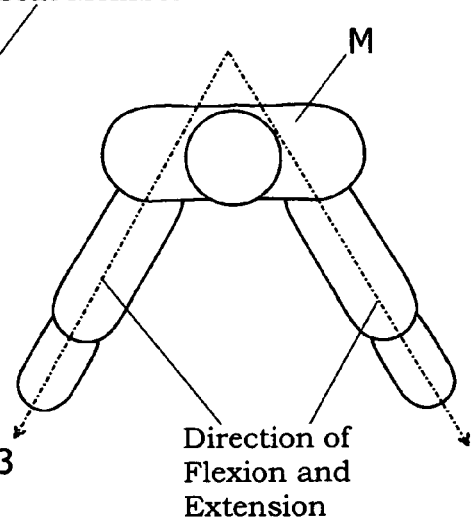

By the way, when the user has knee pain, the motor 6 is driven such that the oscillating direction of the seat member 2 (i.e., a direction of the relative positional displacement between the position of center of the gravity of the user and the foot position on the footplate 3) is limited to a direction of flexion and extension of knee joint. In this case, a displacement direction of the center of gravity of the user becomes parallel to the direction of flexion and extension of knee joint of the user. FIG. 2C is a view observed from above of the user in the sitting posture, and each arrow shown in this figure corresponds to the direction of flexion and extension of knee joint. For example, when time-series data of the motor 6 is installed in the controller 10 such that the oscillating motion of the seat member 2 is provided in the direction of flexion and extension of knee joint, the coupling mechanism 4 limits the oscillating direction of the seat member 2. When driving the motor 6, it is preferred that the movable range of the seat member 2 is limited such that a range of flexion and extension of knee joint is in a range from the extension position to 45 degrees. Thus, since the direction of flexion and extension of knee angle is limited without causing torsion of the knee joint, and the (angular) range of flexion and extension of the knee joint is also limited, the user having knee pain such as osteoarthritis of the knee joint can safely perform the leg training without clinical deterioration or knee pain.

As described above, when limiting the oscillating direction of the seat member 2 to the direction of flexion and extension of knee joint, it is preferred to appropriately determine the foot position and the toe direction on the footplate 3, or detect the foot position and the toe direction by use of a sensor, in addition to the control of the oscillating direction of the seat member 2. In this embodiment, a mark (not shown) for easily determining the foot position and the toe direction is provided on the footplate 3. In addition, it is further preferred the footplate has a toe clip portion such as a top end portion of slipper or sandal to receive the toe.

In addition, when the leg training is performed by applying the load to only one leg, the one leg is placed on the footplate 3, and the oscillating motion of the seat member 2 is provided in two planes respectively including a portion for supporting the user's hip and the second toe of each of the user's legs by the coupling mechanism 4. For example, as shown in FIG. 2A, when the seat member 2 is in an upright posture against the base 1, a larger load is applied to the seat member 2 than the footplate 3 by the user's own weight. On the other hand, as shown in FIG. 2B, when the seat member 2 is in the inclined posture to the base 1, the load applied to the footplate by the user's own weight becomes larger, as compared with the case of FIG. 2A. That is, the load applied to the femoral region by the user's own weight is larger in the case of FIG. 2B than the case of FIG. 2A. In FIG. 2B, a part of the user's own weight is still applied to the seat member 2, it becomes a light exercise, as compared with the case of performing squat exercise by using all of the user's own weight. Thus, the leg training equipment becomes available to user having knee pain by adjusting the load applied to the knee joint. In addition, since the flexion and extension of the knee joint enables without torsion, clinical deterioration or knee pain can be prevented.

In the present embodiment, since the leg training equipment has the pair of footplates 3 for both legs, the oscillating direction of the seat member 2 can be limited every leg such that the direction of the relative positional displacement between the foot position and the position of center of gravity is in agreement with the direction of flexion and extension of knee joint. That is, the user places the feet on the footplates 3 in a state that the user's leg are slightly opened from their parallel position, as shown in FIG. 2C. In addition, the oscillating motion of the seat member 2 is not provided in the forward and backward direction. That is, the oscillating motion is provided between a position where the seat member 2 is in the upright posture against the base 1 and a position where the seat member 2 is inclined in a forward left or forward right direction. By this motion of the seat member 2, the load can be alternately applied to each of the legs in such a manner that when one leg receives the training, the other one leg is in rest position.

When the user places the feet on the footplates 3 in parallel, and the oscillating motion of the seat member 2 is provided in the forward and backward (flexion and extension) direction in a state that the motions of the footplates 3 are locked to uniformly apply the load to both legs, there is an advantage that the equipment is simplified. However, the load applied to each of the legs is 50% of the user's own weight at a maximum. Therefore, when it is needed to further increase the load to be applied to the user's leg, it is preferred to use the leg training equipment described above. In addition, when the load is applied to the user's legs in the parallel posture, there is a fear that the load applied to one leg becomes larger than the load applied to the other leg due to a difference in muscle strength between the right and left legs or a difference in degree of knee pain between the right and left knee joints. According to the present embodiment, it is possible to alternately provide an appropriate load to each of the legs.

Figure 3A:
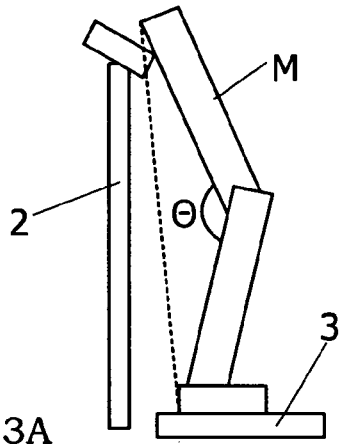
FIGS. 3A and 3B are explanatory views showing an operation of the leg training equipment with a movable footplate.
Figure 3B:
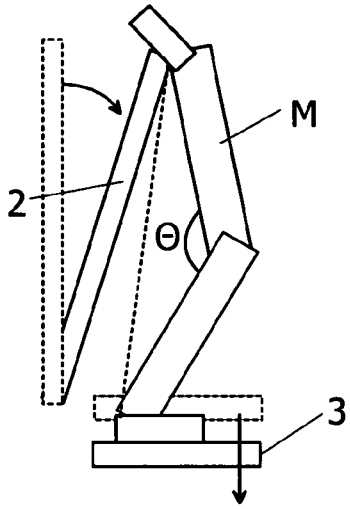

As described above, the footplate 3 is movable to the base 1 in the up and down direction, and the motion of the footplate 3 can be controlled in synchronization with the oscillating motion of the seat member 2. That is, FIG. 3A shows a position of the footplate 3 when the seat member 2 is in the substantially upright posture, and FIG. 3B shows a position of the footplate 3 when the seat member 2 is in the inclined posture. From these figures, it can be understood that the footplate 3 is located at a lower position in the inclined posture than the upright posture of the seat member 2. This can be achieved by controlling the motor 6 for tilting the seat member 2 in synchronization with the motors 7 for moving the footplates 3 in the up and down direction.

Thus, when the footplate is moved downward as the inclination angle of the seat member 2 increases, the load applied to the user's leg can be changed by the user's own weight without substantially changing the bending angle of the knee joint. That is, the leg muscles can be contracted in a isometric contraction manner, so that the muscles contraction with less load applied to the user's knee is obtained. In addition, since the seat member 2 and the footplate 3 are driven by the motors 6, 7, the user can efficiently perform the leg training by simply following the motions of the seat member 2 and the footplates 3 without actively moving its body.

In addition, when the seat member 2 is inclined from the substantially upright posture toward one of the left and right footplates 3, it is preferred to move only the footplate 3 located at a side of providing the oscillation (inclination) motion of the seat member 2 in the downward direction. In this case, the load can be efficiently applied to a desired one of the legs. At this time, the footplate 3 located at the other side may be slightly moved in the upward direction. In this case, a larger load can be efficiently applied to the user's leg by a relatively small inclination of the seat member 2. The oscillating motion of the seat member 2 may be repeated for only one of the left and right legs. Alternatively, it may be alternately provided to each of the left and right legs.

Figure 4A:
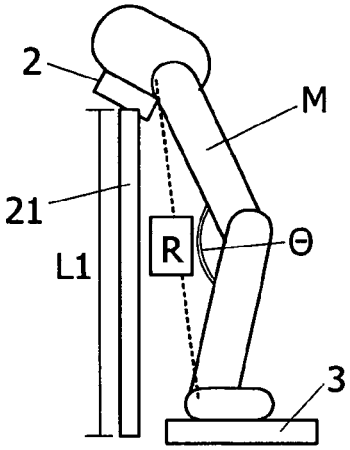
FIGS. 4A and 4B are explanatory views showing an operation of the leg training equipment with a stationary footplate.
Figure 4B:
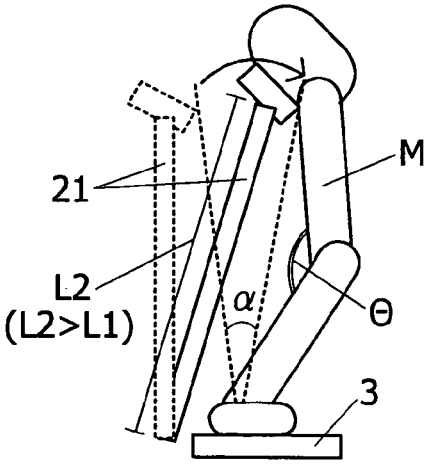

In addition, as a modification, it is preferred that the footplates 3 are fixed, and the motors 6, 8 are controlled in a synchronous manner such that the inclination angle of the seat member 2 is interlocked with the extension and contraction of the post 21. That is, FIG. 4A shows a length L1 of the post 21 when the seat member 2 is in the upright posture, and FIG. 4B shows a length L2 of the post 21 when the seat member 2 is in the inclined posture. The length of the post 21 becomes large ($L1<L2$) when the seat member 2 is in the inclined posture. In this case, it is possible to change the load applied to the leg by the user's own weight without substantially changing the bending angle $\theta$ of the knee joint.

The following is a further explanation about a preferred motion path of the seat member 2 when the footplates are not moved. In FIGS. 4A and 4B, the post length is extended such that a change in knee angle does not happen. A distance between the foot and the hip, specifically between the hip joint and the ankle joint (ankle) is designated by a radius "R". The inclination angle of the seat member 2 is controlled such that the hip traces a circular path having the ankle joint as a rotation center (in figure, the angle range is designated by "α"). When the angle range "α" is small, the circular path may be approximated by a linear path because an error therebetween is negligible.

Figure 5A:
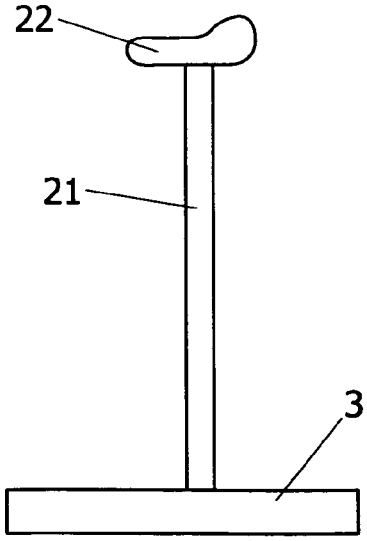
FIGS. 5A and 5B are explanatory views showing an operation of a saddle when a seat member is inclined.
Figure 5B:
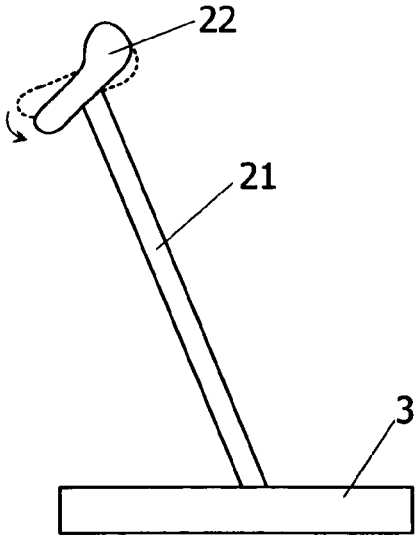

In this embodiment, since an inclination angle of the saddle 22 relative to the post 21 is changed in the forward and backward direction by the motor 9, the inclination angle of the seat member 2 and the inclination angle of the saddle 22 can be controlled in an interlocking manner. That is, as shown in FIG. 5A, when the seat member 2 is in a substantially upright posture against the base 1, a plane orthogonal to the axial direction of the post 21 is substantially in parallel to a seating surface of the saddle 22. On the other hand, when the seat member 2 is inclined, a seesaw motion of the saddle 22 happens at the joint portion 23 such that a forward end of the saddle 22 moves downward. At this time, the plane orthogonal to the axial direction of the post 21 intersects with the seating surface of the saddle 22. The inclination degree of the saddle 22 increases as the inclination angle of the seat member 2 becomes larger. In brief, the load applied to the leg can be further increased by both of the inclination angles of the seat member 2 and the saddle 22. On the contrary, when the saddle 22 is inclined in an opposite direction against the above case as the inclination angle of the seat member 2 increases, the load applied to the leg can be reduced as the inclination of the seat member 2 becomes larger.

As described above, when controlling at least two of the motors 6 to 9 in a synchronous manner, it is possible to obtain a motion that the bending angle of the knee joint is kept constant, change the ratio of the load applied to the leg relative to the user's own weight, or adjust a change in load applying pattern with respect to time. These can be optionally combined, and controlled by the controller 10 depending on athletic ability and physical condition of the user to determine an appropriate motion.

In the above explanation, the footplate 3 is movable relative to the base 1 in the up and down direction (vertical direction). Alternatively, the footplate may be movable relative to the base 1 in a horizontal (parallel) direction. For example, when it is controlled that a horizontal distance between the footplate 3 and a bottom end of the seat member 2 becomes small as the inclination angle of the seat member 2 increases, the load applied to the leg can be changed without changing the bending angle of the knee joint. In addition, when the footplate is movable to relative to the base 1 in both of the vertical and horizontal directions, the inclination angle of the seat member 2 may be interlocked with the movement of the footplate 3.

The structure of the footplate is not limited. For example, it is preferred that a single spring member is disposed under the footplate, and a spring constant of the spring member is determined such that a desired amount of descent is obtained in response to the load. Alternatively, the amount of descent may be adjusted by use of a plurality of spring members with different spring constants in response to the load (e.g., by use of 2-stage spring having a nonlinear spring constant). In addition, the amount of decent can be appropriately adjusted by selectively changing the number used of a plurality of springs having the same spring constant in response to the user's body weight or the target load. Moreover, the amount of descent of the footplate may be adjusted by controlling an air amount of an air piston disposed under the footplate in response to the user's body weight or instantaneous value of the load. Furthermore, the position of the footplate may be controlled by expansion and contraction of an airbag or an air tube disposed under the footplate depending on the load applied to the footplate.

Figure 6:
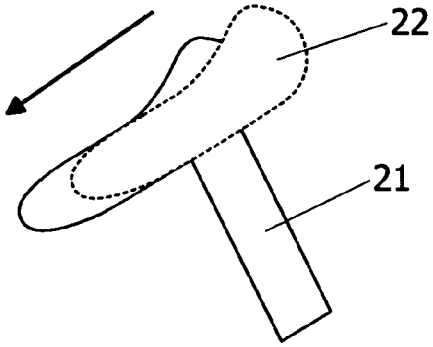
FIG. 6 is an explanatory view showing another operation of the saddle when the seat member is inclined.

In the above case, the inclination angle of the saddle 22 relative to the top end of the post 21 is changeable in the forward and backward direction. Alternatively, as shown in FIG. 6, the saddle 22 may be sidable in one (forward and backward) direction in a plane intersecting with the axial direction of the post 21. In this case, the slide movement of the saddle 22 relative to the post 21 is provided by the motor 9. As the inclination angle of the seat member 2 increases, the saddle 22 is slid in the forward direction (in the figure, the dotted line shows a position of the saddle 22 on the seat member 2 in the upright posture), so that the user's hip moves forward. This allows the user to take a substantially standing posture, and consequently increases the load applied to the user's leg.

In the above case, four factors of the inclination angle of the seat member 2 relative to the base 1, the position of the footplate 3 relative to the base 1, extension and contraction length of the seat member 2, and the position of the saddle 22 relative to the post 21 are controlled by use of the motors 6 to 9. Alternatively, a change in the inclination angle of the seat member 2 is interlocked with a positional change of the saddle 22 relative to the post 21. In this case, the motor 9 for driving the saddle 22 can be omitted.

Figure 7A:
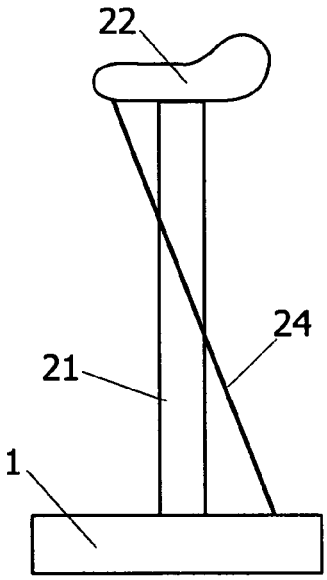
FIGS. 7A and 7B are explanatory views showing an example of a joining means for the saddle of this embodiment.
Figure 7B:
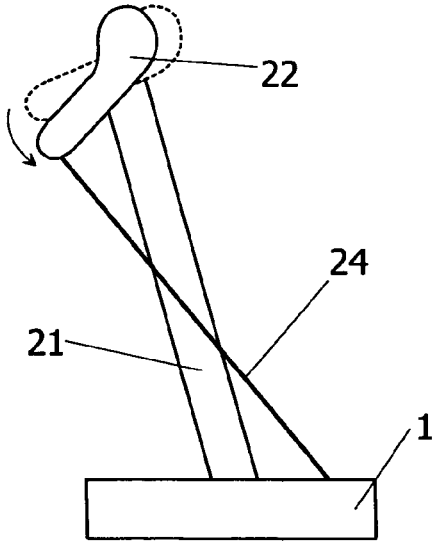

For example, as shown in FIGS. 7A and 7B, a wire 24 of a rigid material having poor elongation property is connected between a forward end of the saddle 22 and the base 1 to change an inclination angle of the saddle 22 against the post 21. The saddle 22 can be inclined in the forward and backward direction against the post 21. In addition, the saddle 22 is spring-biased such that the seating surface of the saddle 22 is returned to a position substantially orthogonal to the axial direction of the post 21. FIG. 7A designates an upright posture of the seat member 2 against the base 1, and FIG. 7B designates an inclined posture of the seat member 2 to the base 1. At this time, since the forward end of the saddle 22 is restricted by the wire 24, it is inclined forward against the spring bias, as shown in FIG. 7B. When the seat member 2 takes the upright posture, as shown in FIG. 7A, the saddle 22 is returned to the original position where the seating surface of the saddle 22 is substantially orthogonal to the axial direction of the post 21. When a rod having a constant length is used as in place of the wire 24, it is not needed that the saddle 22 is spring-biased at the top end of the post 21.

Figure 8A:
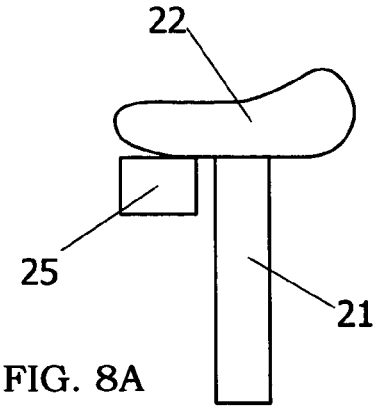
FIGS. 8A and 8B are explanatory views showing another example of the joining means for the saddle.
Figure 8B:
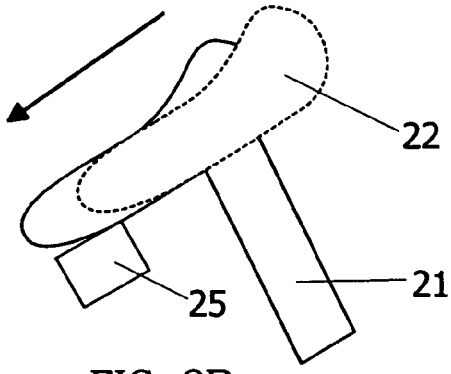

In addition, when the saddle 22 is supported to be sidable to the post 21, it is preferred that a weight of the forward end of the saddle 22 is larger than the weight of the backward end thereof. For example, when the seat member 2 is moved from an upright posture shown in FIG. 8A to an inclined posture shown in FIG. 8B, a forward movement of the saddle 22 is obtained by a weight 25.

Figure 9:
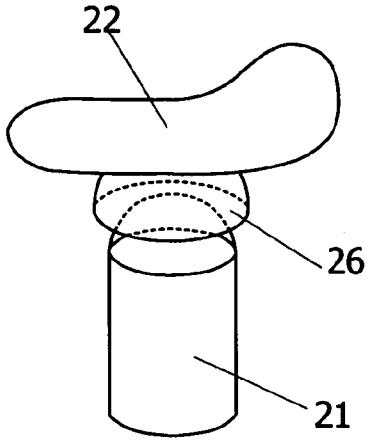
FIG. 9 is a perspective view showing still another example of the joining means for the saddle.

In addition, as shown in FIG. 9, the post 21 may be connected to the saddle 22 by use of a ball joint. In this case, the saddle 22 can be inclined to the post 21 in an optional direction. Therefore, when the seat member 2 is in the upright posture, the post 21 receives most of the load applied to the saddle 22. On the other hand, when the seat member 2 is inclined, the user's leg partially receives the own weight, so that muscle contraction happens at the leg. That is, it is possible to further increase the load applied to the user's leg when the seat member 2 is in the inclined posture, as compared with the case of fixing the saddle 22 to the post 21.

By the way, a major purpose of the leg training equipment is to enhance sugar metabolism of the user and improve lifestyle-related diseases. That is, when glucose that is an energy source of muscles is taken in the muscles, and then metabolized, surplus glucose is consumed to improve hyperglycemia and elevated levels of insulin in the plasma, so that an improvement in lifestyle-related diseases (diabetes, obesity, hyperlipemia and so on) is enhanced. As the action of uptaking glucose into the muscles, there are insulin action and muscle contraction action, which are correlated to each other. When the glucose amount uptaken in the muscles is increased by the muscle contraction, a promotion of sugar metabolism becomes possible. In general, a diabetic patient has poor sugar metabolism, as compared with healthy subject, and the glucose amount uptaken in the muscles is small. Therefore, surplus glucose can be consumed by actively causing the muscle contraction to accelerate the sugar metabolism. Consequently, it contributes to an improvement in diabetes.

To efficiently obtain sugar metabolism by the muscle contraction, it is preferred to cause the muscle contraction at the muscles having large volume (particularly, red muscles (slow muscles) contributing to aerobic exercise). From this viewpoint, it is preferred to cause the muscle contraction at the femoral region or the back of the user. In the conventional horse-riding apparatus, an increase in sugar metabolism is obtained in the vicinity of adductor muscle of the femoral region. However, since the volume of the adductor muscle is only a half of the volume of extensor muscles of the femoral region, the effect of enhancing sugar metabolism is relatively small, as compared with the case of causing the muscle contraction at the extensor muscles. In addition, although the user rarely puts its feet in stirrups during the horse-riding exercise, the user's legs are usually kept in a floating state without contacting the ground. Therefore, the user performs the training by causing the muscle contraction in a state that a horseback seat is put between the femoral regions of the user's legs. Therefore, it becomes a hard exercise in respect of the magnitude of the load applied to the femoral regions.

As described above, it is preferred that metabolism is increased within a physiological acceptable range of the user. However, since there is a limitation in the load to be applied to the user having knee pain, which is caused by the flexion and extension of the knee joint, it is needed to operate the leg training equipment so as to avoid the occurrence of knee pain. The leg training equipment of this embodiment is characterized by providing the oscillating (inclination) motion to the seat member 2, on which the user's hip is placed, thereby applying at least a part of the user's own weight as the load to the user's leg. In this case, the instantaneous value of the load depends on the inclination angle. In addition, there is a correlation between muscle metabolism or sugar metabolism and an accumulated amount of the load (hereinafter, called as load amount). Therefore, the load amount per unit time depends on oscillating (inclination) speed of the seat member 2. In addition, when the user's own weight is applied to the leg, it is assumed that the knee pain easily happens as the knee joint is bent by a larger angle from the extension position. Therefore, it is also needed to consider the angle of the knee joint. In the following explanation, the angle of the knee joint relative to the extension position is defined as "knee angle". The knee angle can be calculated by subtracting the bending angle θ of the knee joint from 180 degrees. That is, a sum of the bending angle and the knee angle is equal to 180 degrees.

In this embodiment, the following four measurements were performed with regard to muscle metabolism (or sugar metabolism). In addition, the following five measurements were performed with regard to knee pain. Conditions of operating the leg training equipment were determined according to evaluation results of the measurements. The seat member 2 is moved in a reciprocating manner between a position where the seat member 2 is in a substantially upright posture against the base 1 and a position where the seat member is in an inclined posture thereto. Reciprocating number (unit: Hz) described below is defined as the number of reciprocating motions repeated per one second, wherein one reciprocating motion is provided by a movement of the seat member from the upright posture toward the inclined posture, and a return movement of the seat member from the inclined posture toward the upright posture. Therefore, as the reciprocating number increases, the movement speed of the seat member 2 becomes fast. "Own weight ratio" is defined as a percentage value of a ratio of the load applied to the footplate 3 relative to the user's own weight (body weight). Since the load applied to the footplate 3 changes with time, a peak value of the load applied during the one reciprocating motion of the seat member 2 is used as a representative value. In addition, since the representative value fluctuates every reciprocating motion, an average value of the representative values obtained for 1 minute is used.

Measurement conditions for evaluating muscle metabolism or sugar metabolism are shown in Table 1, and measurement conditions for evaluating the knee pain are shown in Table 2. In Table 1, the measurements 1 to 3 were performed to evaluate the muscle metabolism, and the measurement 4 was performed to evaluate the sugar metabolism. The muscle metabolism was measured by means of near-infrared spectroscopy, and the sugar metabolism is measured by glucose clamp test. For the evaluations of muscle metabolism and sugar metabolism, results are compared with the case of using a leg training device (hereinafter, called as conventional device) having the capability of providing a horse-riding motion to the user on a horseback seat.

TABLE 1

| | Subjects | (Reciprocating Number, Knee Angle, Own Weight Ratio) |
|---|---|---|
| Measurement 1 | 3 Healthy Subjects | (1, 20, 20), (1, 20, 40), (1, 40, 20), (1, 40, 40), (0.3, 20, 20), (0.3, 20, 40), (0.3, 40, 20), (0.3, 40, 40) |
| Measurement 2 | 5 Healthy Subjects | (1, 40, 40) |
| Measurement 3 | 3 Healthy Subjects | (1, 40, 40), (1.43, 40, 40), (1.43, 40, 60), (2, 40, 60) |
| Measurement 4 | 2 Healthy Subjects | (2, 40, 60) |

TABLE 2

Figure 13:
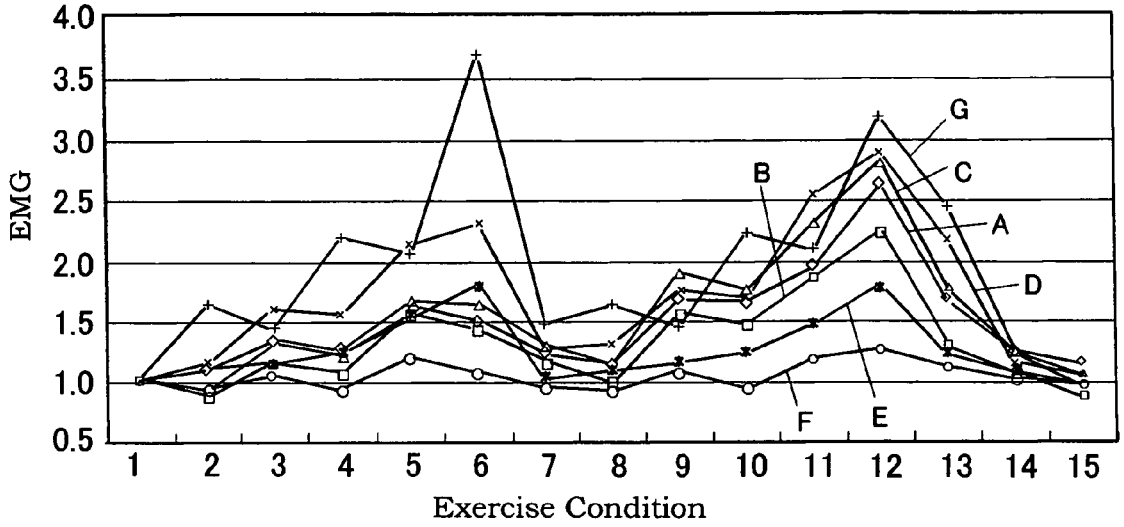
FIG. 13 is a graph showing relations between exercise condition and integrated EMG.

| | Subjects | (Reciprocating Number, Knee Angle, Own Weight Ratio) | Others |
|---|---|---|---|
| Measurement 5 | 7 Knee Pain OA Subjects | (1, 10, 20), (1, 10, 40), (1, 20, 20), (1, 20, 40), (1, 40, 20), (1, 40, 40), (0.3, 10, 20), (0.3, 10, 40), (1, 20, 20), (1, 20, 40), (0.3, 40, 20), (0.3, 40, 40) | Sensory Evaluation |
| Measurement 6 | 15 Knee Pain OA Subjects | (1, 40, 40) | Continuously performed for 15 minutes |
| Measurement 7 | 3 Healthy | Conditions of FIG. 13 | Heel Position |

TABLE 2-continued

| | Subjects | (Reciprocating Number, Knee Angle, Own Weight Ratio) | Others |
|---|---|---|---|
| Measurement 8 | Subjects 5 Knee Pain OA Subjects | Conditions of FIG. 13 | Electromyogram Heel Position Sensory Evaluation |
| Measurement 9 | Subjects 5 Knee Pain OA Subjects | (2, 40, 60) | Continuously performed for 15 minutes |

In the measurement 1 for evaluating the muscle metabolism shown in Table 1, the load was applied to only one leg. In this case, there was no significant difference of muscle metabolism with regard to the reciprocating number and the knee angle. However, there was a significant difference of muscle metabolism with regard to own weight ratio. The maximum muscle metabolism in the measurement 1 reaches 1.5 times of the case of using the conventional device. In addition, it is 1.2 times of the case of using the conventional device in the measurement 2.

Figure 10:
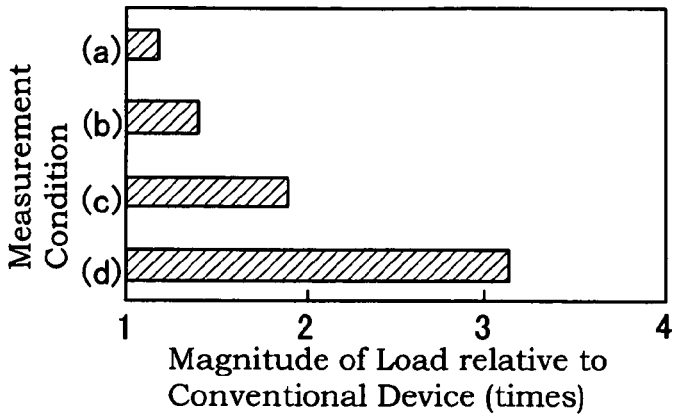
FIG. 10 is a graph showing measurement results of muscle metabolism.

Results of muscle metabolism measured in the measurement 3 are shown in FIG. 10. In FIG. 10, (a) shows a case that the reciprocating number is 1 Hz, the knee angle is 40 degrees, and the own weight ratio is 40%, (b) shows a case that the reciprocating number is 1.43 Hz, the knee angle is 40 degrees, and the own weight ratio is 40%, (c) shows a case that the reciprocating number is 1.43 Hz, the knee angle is 40 degrees, and the own weight ratio is 60%, and (d) shows a case that the reciprocating number is 2 Hz, the knee angle is 40 degrees, and the own weight ratio is 60%. As apparent from FIG. 10, the load obtained in the case (d) is 3.1 times of the case of using the conventional device. That is, when the reciprocating number is not greater than 1 Hz in the measurement 1, there was no significant difference of muscle metabolism with respect to the reciprocating number. However, when the reciprocating number exceeds 1 Hz, a significant difference appears in muscle metabolism.

Figure 11:
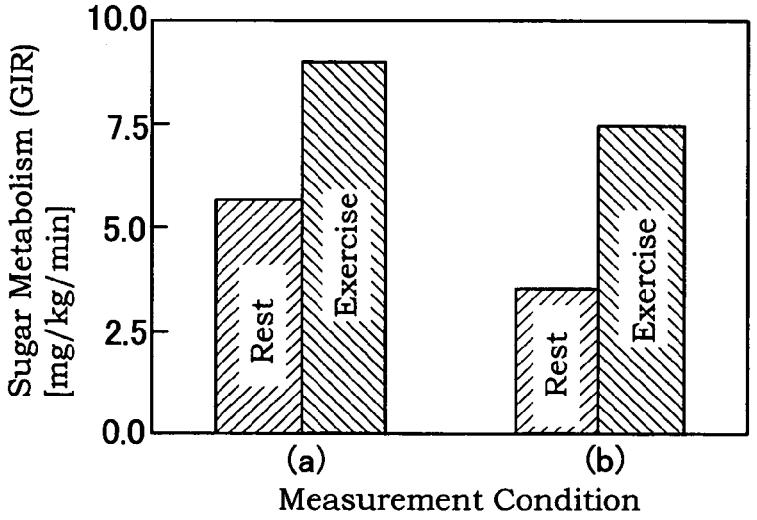
FIG. 11 is a graph showing measurement results of sugar metabolism.

In the measurement 4, when the oscillating motion of the seat member 2 is started from a position where tibia is upright against the base 1, the sugar metabolism obtained is 1.35 times of the case of using the conventional device. In FIG. 11, (a) shows the sugar metabolism measured at rest and exercise durations in the case of using the conventional device, and (b) shows the sugar metabolism measured at the rest and exercise durations in the case of using the leg training equipment of the present invention. As apparent from these results, when the conventional device is used, the sugar metabolism measured at the exercise duration is 1.6 times of that measured at the rest duration. On the other hand, when using the equipment of the present invention, the sugar metabolism measured at the exercise duration is 2.1 times of that measured at the rest duration. This means that a sugar metabolism effect is increased by 1.35 times. Consequently, it is preferred that the reciprocating number is 2 Hz, the knee angle is 40 degrees, and the own weight ratio is 60% from the viewpoints of muscle metabolism and sugar metabolism.

Next, the measurements for evaluating the knee pain shown in Table 2 were performed by use of a face pain scale depending on a degree of pain. The face pain scale was prepared such that there are 20 different expressions between smiling face and crying face, and each of the expressions has a predetermined score. When there is no pain, the smiling face having the highest score (20 points) is selected. On the other hand, as the pain increases, the expression closer to the crying face (i.e., the score is smaller than 20 points) is selected.

Figure 12:
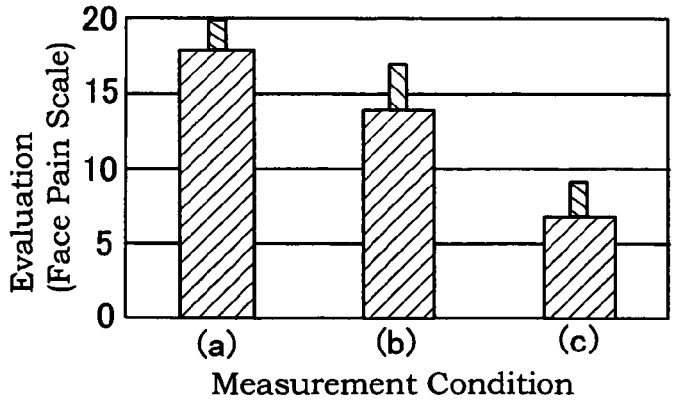
FIG. 12 is a graph showing sensory evaluation results of knee pain.

In the case of evaluating under the conditions of the measurement 5, the knee pain is negligible, and there was no significant difference of knee pain with regard to the knee angle. In addition, with regard to the position of tibia at the time of starting the oscillating motion of the seat member 2, there was no significant difference between the position where it is in a vertical direction to the base 1 and the position where it is inclined in the downward and forward direction. Depending on the reciprocating number and the own weight ratio, the degree of knee pain was slightly changed. In each of the case (a) of using the leg training equipment of the present invention, the case (b) of walking on a flat surface, and the case (c) of descending steps, the degree of knee pain was evaluated by use of the face pain scale. Results are shown in FIG. 12. The knee pain is remarkably smaller in the case (a) than the case (c). In addition, even when compared with the case (b), it is understood that the knee pain is small in the case (a). In FIG. 12, a projection on a top of each of the bar graphs designates standard deviation.

The measurement 6 was performed to investigate as to whether the knee pain happens after the leg training equipment of the present embodiment is continuously used for 15 minutes. In this case, the upright posture of tibia was used as the starting position. Under the conditions of the measurement 6, the knee pain did not happen during and after the training.

In the measurement 7, myoelectric potentials of rectus femoris muscle A, lateral vastus muscle B, medial vastus muscle C, adductor muscle D, gastrocnemial muscle E, anterior tibial muscle F, biceps femoris muscle G were measured under conditions shown in Table 3. An average value of EMG (integrated myoelectric potential) of each of the muscles was determined from the measurement results. FIG. 13 shows plots of the obtained average values.

In Table 3, the term "High" in the column "Heel" means that the sole is inclined such that the heel is higher than the toe. In this case, an inclination angle of the footplate 3 is 10 degrees.

TABLE 3

| Condition No. | Reciprocating Number | Knee Angle | Own Weight Ratio | Heel |
|---|---|---|---|---|
| 1 | 1 | 40 | 40 | |
| 2 | 1 | 40 | 40 | High |
| 3 | 1 | 40 | 60 | |
| 4 | 1 | 40 | 60 | High |
| 5 | 1 | 40 | 80 | |
| 6 | 1 | 40 | 80 | High |
| 7 | 1 | 60 | 40 | |
| 8 | 1 | 60 | 40 | High |
| 9 | 1 | 60 | 60 | |
| 10 | 1 | 60 | 60 | High |
| 11 | 1 | 60 | 80 | |
| 12 | 1 | 60 | 80 | High |
| 13 | 2 | 40 | 40 | |
| 14 | 1.67 | 40 | 40 | |
| 15 | 1.25 | 40 | 40 | |

In FIG. 13, when the case that the heel is higher than the toe (exercise conditions 2, 4, 6, 8, 10, 12) is compared with the case that the toe and the heel are at substantially the same level, it is understood that muscle contractions of the gastrocnemial muscle E and the biceps femoris muscle G are high on the condition that the heel is higher than the toe, and other conditions are the same.

On the other hand, in the measurement 8, a sensory evaluation was performed under the conditions of the measurement 7, i.e., under the same conditions except for changing the heel height. As a result, when the heel is higher than the toe, a reduction in knee pain was confirmed. It is believed that this reduction effect of the knee pain is because the motion of the knee joint is inhibited by an antagonistic action of muscle contractions caused by both of quadriceps femoris muscle that is located at the front side of the leg and biceps femoris muscle that is located at the back side of the leg, so that a shear force acting on the knee joint is reduced.

In the measurement 9, as in the case of the measurement 6, the occurrence of knee pain after the leg training equipment is continuously used for 15 minutes was checked. No knee pain happened during and after the leg training performed under the conditions of the measurement 9. From these measurement results, to prevent the occurrence of the knee pain, it is preferred that the reciprocating number is 2 Hz, the knee angle is 40 degrees, and the own weight ratio is 60%.

Figure 14:
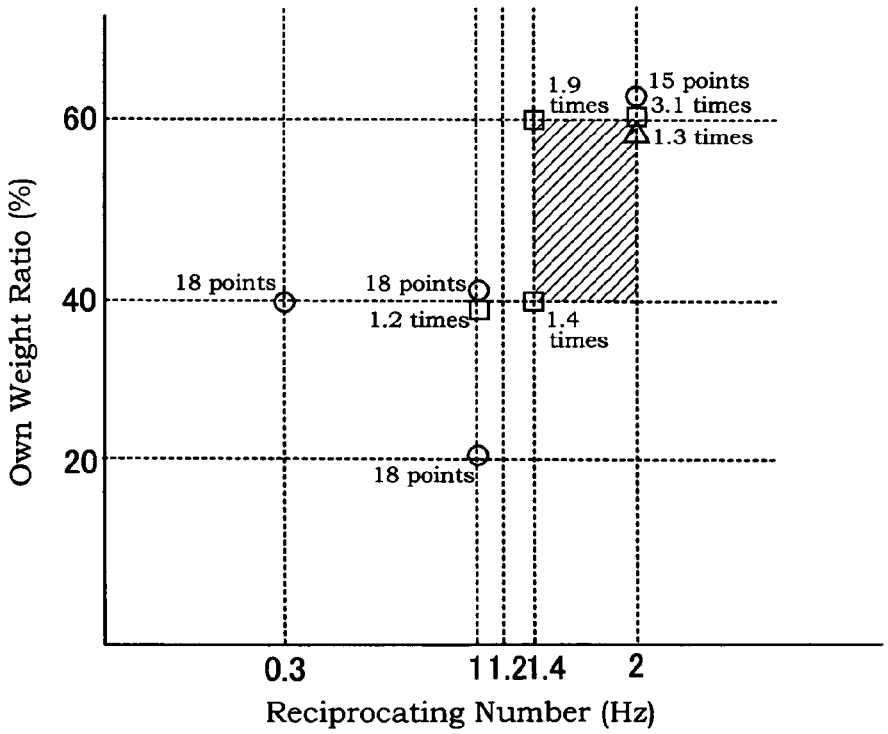
FIG. 14 is a graph showing a relation between own weight ratio applied to the footplate and reciprocating number of oscillating motion of the seat member.

According to the results obtained by the measurements shown in Tables 1 and 2, FIG. 14 shows a relation between the conditions of the own weight ratio and the reciprocating number and the sensory evaluations of muscle metabolism, sugar metabolism and knee pain in the case that the knee angle is 40 degrees. In FIG. 14, the horizontal axis is the reciprocating number, and the vertical axis is the own weight ratio. The symbols "□", "Δ", "○" respectively designate the sensory evaluations of muscle metabolism, sugar metabolism and knee pain. The muscle metabolism and the sugar metabolism are represented by magnification of the case of using the leg training equipment relative to the case of using the conventional device. In FIG. 14, the upper right direction corresponds to a direction of increasing metabolism, and the lower left direction corresponds to a high score direction (of reducing the knee pain).

In conclusion, it is obtained from the measurements shown in Table 1 that it is preferred that the reciprocating number is 2 Hz, the knee angle is 40 degrees, and the own weight ratio is 60% to achieve desired muscle metabolism and sugar metabolism. In addition, it is understood that the keep pain does not happen after the leg training is continuously performed for 15 minutes under the above conditions. Therefore, it can be said that the above conditions are preferable as the exercise conditions. The above conditions should be regarded as upper limit values. When it is needed to decrease muscle metabolism and sugar metabolism, more light exercise conditions will be used. In FIG. 14, a hatched region designates a region having desired metabolism and a high score between 15 points and 20 points in the knee-pain sensory evaluation, in which knee pain does not happen even after the training equipment is continuously used for 15 minutes. Therefore, it is recommended to select the conditions from this range with the reciprocating number of 1.4 to 2 Hz and the own weight ratio of 40 to 60%. In addition, as the exercise starting position, it is preferred to use the position where tibia is upright against the base 1.

By the way, the reciprocating number can be changed by controlling the motion of the seat member 2. In addition, the knee angle can be maintained constant by controlling the positional relation between the seat member 2 and the footplate 3. On the other hand, the own weight ratio is the load applied to the footplate 3 by the user. As the movement speed of the seat member 2 increases, greater acceleration occurs at the time of a change in the movement direction. That is, a larger load is applied to the footplate. In addition, as the inclination angle of the seat member 2 increases, a ratio of the load received by the seat member 2 relative to the user's own weight becomes small. Consequently, the load received by the footplate 3 increases. Thus, the own weight ratio has both of the reciprocating number and the inclination angle as parameters. Since the user's body weight is in a range of several ten kg, it is presumed that there is a linear relation between the own weight ratio and the reciprocating number and the inclination angle in such a narrow range. As shown by the following equation, an estimated value of the load is obtained by assigning required weights (a, b) respectively to the reciprocating number and the inclination angle, and then determining a linear sum of them. The weights are determined such that this estimated value corresponds to the own weight ratio. In the equation, the inclination angle means the maximum inclination angle.

$$\text{(Estimated value of Load)} = aX(\text{reciprocating number}) + bX(\text{inclination angle})$$

Figure 15:
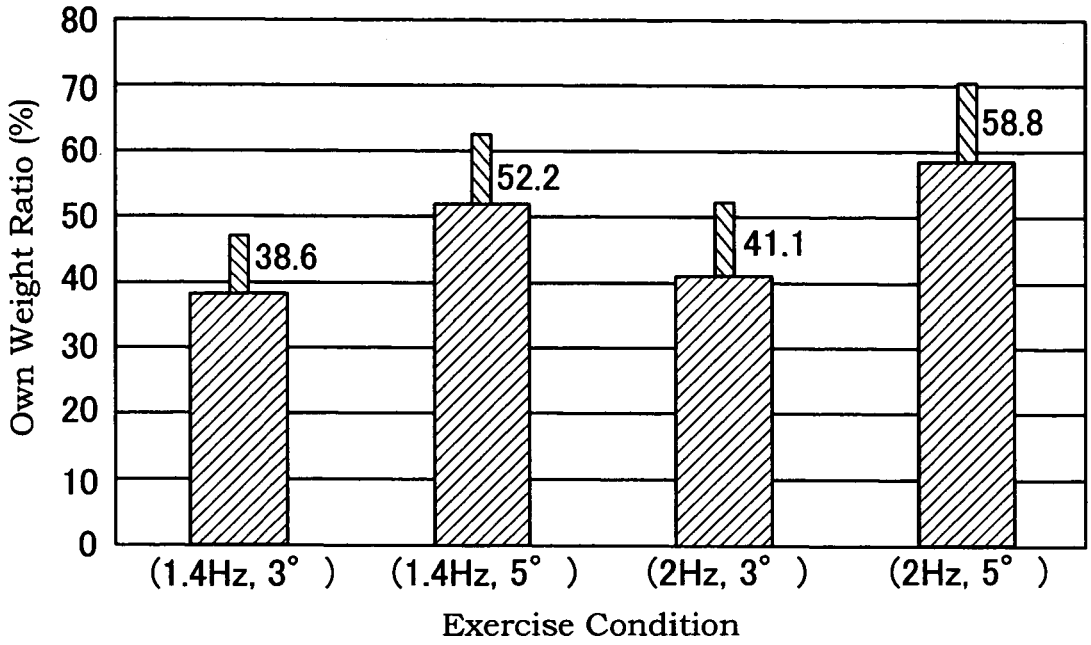
FIG. 15 is a graph showing relations between exercise condition and own weight ratio applied to the footplate.

FIG. 15 shows actual measurement results of the own weight ratio under different conditions of the reciprocating number and the inclination angle. That is, with respect to eight adult persons who have not experience in using the equipment of the present invention, the measurement was performed under conditions that the knee angle is kept at 40 degrees, and the load applied to the right leg is continuously recorded for 1 minute. In FIG. 15, the relations of (reciprocating number, inclination angle, own weight ratio) are respectively (1.4 Hz, 3 degrees, 38.6%), (1.4 Hz, 5 degrees, 52.2%), (2 Hz, 3 degrees, 41.1%), (2 Hz, 5 degrees, 58.8%). As a result of multiple linear regression analysis performed by use of these values and the above regression expression, the weights (a, b) are 8.9 and 8.1, respectively. That is, the own weight ratio can be determined by the following equation according to the reciprocating number and the (maximum) inclination angle.

$$\text{(Own weight ratio[\%])} = 8.9 \times (\text{reciprocating number[Hz]}) + 8.1 \times (\text{inclination angle[degree]})$$

In the case of determining the own weight ratio by the above equation, the inclination angle of the seat member 2 in the hatched region in FIG. 14 is within a range of 2.7 to 5.7. Therefore, it is desired to set the inclination angle within the range of 3 to 5 degrees. That is, when the knee angle is set at 40 degrees, the reciprocating number of the seat member 2 is in a range of 1.4 to 2 Hz, and the inclination angle of the seat member 2 is in the range of 3 to 5 degrees, it is possible to perform the leg training for obtaining desired metabolism without causing the knee pain. In the above case, the knee angle is kept at 40 degrees to obtain a sense of stability in a state that the user's hip is placed on the seat member 2. However, since there is no significant difference with respect to metabolism and knee pain, the knee angle may be smaller than 40 degrees.

From the above results, the present invention can provide a leg training method using the leg training equipment, which has the seat member for supporting the user in the sitting posture and the footplate on which the user's foot are placed, and limits the direction of the relative positional displacement between the foot position and the position of center of gravity of the user during the oscillating (inclination) motion of the seat member in substantially a direction of flexion and extension of knee joint. This leg training is characterized by performing under the conditions that the knee angle is kept at 40 degrees, the reciprocating number of the oscillating motion of the seat member 2 is in the range of 1.4 to 2 Hz, and the inclination angle of the seat member 2 is in the range of 3 to 5 degrees. In addition, this leg training can be realized when the controller 10 controls the motions of the seat member 2 and the footplates 3 such that the reciprocating oscillating motion of the seat member 2 is provided between the position where the seat member is in an upright posture against the base 1 and the position where the seat member is in an inclined posture to the upright posture by an angle of not larger than 5 degrees, the knee angle (angle of the knee joint against the extension position) is kept in a range of not larger than 40 degrees, and the reciprocating number per one second of the oscillating motions of the seat member 2 is not larger than 2.

In the present invention, appropriate led training conditions can be determined, as described above. However, due to individual differences, it is preferred that the equipment has an input unit (not shown) such as keyboard or touch panel for inputting a target value of the load and the reciprocating number into the controller 10. As the target value of the load, the own weight ratio can be used, which is preferably adjustable in a range of 40 to 60% from the above-described reasons. Similarly, the reciprocating number is preferably adjustable in a range of 1.4 to 2 Hz. When the target value of the load and the reciprocating number are input from the input unit, the inclination angle is determined by substituting those input values in the above equation. By controlling the seat member 2 on the condition that the obtained inclination angle is the maximum inclination angle of the seat member 2, it is possible to match the load applied to the user's leg with the target value.

In addition, since the recommended reciprocating number of the seat member 2 is in the range of 1.4 to 2 Hz, and the desired target value is in the range of 40 to 60% of the own weight ratio, the input unit is preferably formed such that only the data input from these ranges is permitted. In addition, it is preferred that when the data other than the above ranges is input, the input unit gives an alert or refuses the input. Alternatively, the input unit may have a function of automatically correcting wrong data input from out of the above ranges according to the appropriate ranges.

As a modification of the present embodiment, it is also preferred to use sensors for detecting the foot position and the toe direction in place of determining them by the footplate, and determine the oscillating direction of the seat member 2 by the controller 10. As the sensor, for example, it is possible to use a weight sensor for detecting plural positions of the sole, or a combination of a TV camera for taking an image of the user's foot and an image processor. In addition, when the movable range of the seat member 2 is limited by the controller 10, a data input unit for inputting the user's data such as leg length is needed in the controller 10. However, in place of forming the data input unit, the movable range of the seat member 2 may be limited by use of a limit switch or a mechanical stopper means.

Figure 16A:
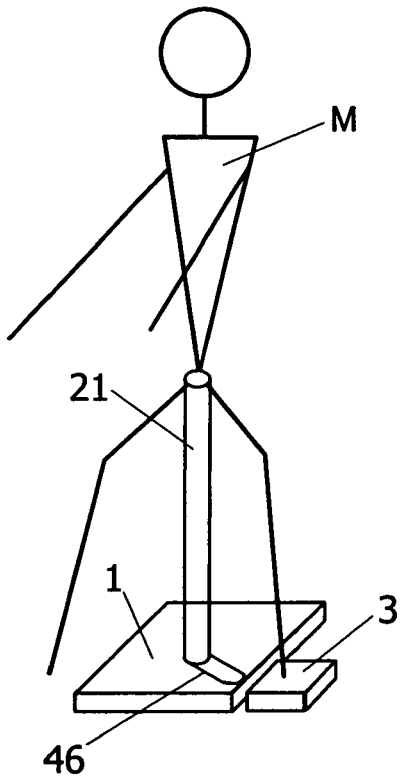
FIGS. 16A and 16B are explanatory views showing a coupling mechanism for the seat member according to a modification of this embodiment.
Figure 16B:
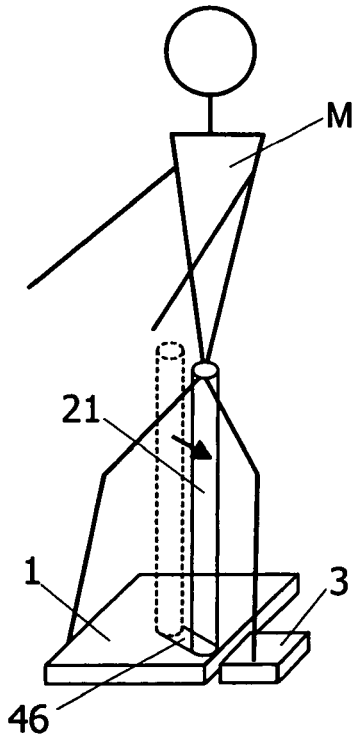

In the above described case, the seat member 2 is pivotally coupled at its bottom end to the base 1 to provide the oscillating motion of the seat member. Alternatively, the load applied to the leg by the user's own weight can be changed without the oscillating motion of the seat member 2. For example, as shown in FIGS. 16A and 16B, it is preferred to use a coupling mechanism for providing a parallel movement of the seat member 2 relative to the base 1, while maintaining an upright posture of the seat member. That is, this coupling mechanism has a guide rail 46 in the top surface of the base 1, along which the bottom end of the seat member can be moved. In this case, the foot position and the toe direction of the user are determined by the footplate, as in the case of the first embodiment. The guide rail 46 is formed on a line connecting between a required position on the base 1 and the footplate 3. When the seat member 2 is moved along the guide rail 46, a distance between the toe and the hip of the user M changes to cause the flexion and extension of the knee joint. That is, the load applied to the leg by the user's own weight can be controlled according to the distance change between the seat member 2 and the footplate 3. In this case, the movable direction of the seat member 2 is limited to the direction of flexion and extension of the knee joint by the guide rail 46. This modification is on the assumption that the user M actively performs the movement of the seat member 2. However, a drive unit for moving the seat member 2 may be used. In the case of FIG. 16A, the load is applied to only one leg. If necessary, guide rails may be formed in two directions to apply the load to the both legs. The other components and functions are the same as the above embodiment. To obtain the relative positional displacement between the foot position and the position of center of gravity, it is enough to move any one of the seat member 2 and the footplate 3. For example, the footplate 3 may be slidable relative to the seat member 2.

In addition, the leg training equipment of this embodiment preferably has a load sensor for detecting the load applied to the user's leg (mainly the femoral region). In this case, the load sensor is disposed at a position underneath the saddle 22 and/or the left and right footplates 3. In other words, it is preferred that at least one of the seat member 2 and the footplates 3 as the support portion has the load sensor. In particular, it is preferred that the load sensor is disposed at each of the footplates 3. In this case, an increase in load detected by the load sensor can be regarded as the load applied to the leg. Of course, when the load is detected by the load sensor disposed at the saddle 22, a decrease in the load detected can be used as a guide of the load applied to the leg.

Figure 17:
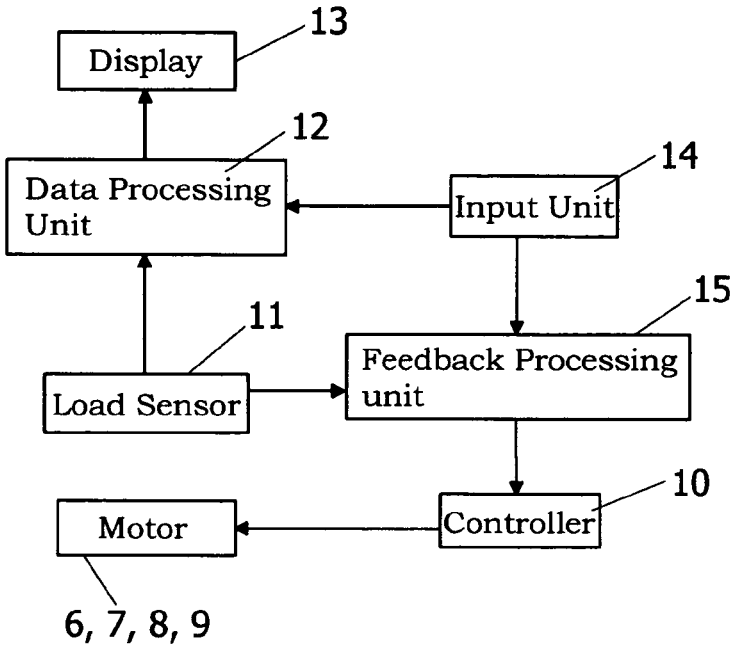
FIG. 17 is a block diagram of a control unit of the leg training equipment.

In addition, as shown in FIG. 17, it is preferred that the load detected by the load sensor 11 is displayed in a real-time manner on a display 13 through a data processing unit 12. In this case, the data processing unit 12 and the display 13 function as a load-change informing unit. Therefore, the load applied to the user's leg is displayed in the real-time manner on the display 13. For example, the information can be provided on the display 13 by means of a numeral value corresponding to the load, a line graph showing a change in load with respect to time, a bar chart having different bar lengths depending on the load, or a meter indication that an angular position of an indicator in a semicircular display region changes depending on the load applied. Since the load changes with time, it is preferred to use the bar chart or the meter indication. In these cases, it is easily to innovate a mark for indicating a target range, as described later. The display 13 is used as the means for visually indicating the load change to the user. If necessary, the load change may be acoustically informed to the user by means of an audible sound having a frequency that is changed in response to the load. In the case of using the visual display function or the sound effect, the user can easily check as to whether the load applied to the user is appropriate or not. When there is excess and deficiency of the load, the magnitude of the load can be appropriately changed by adjusting the equipment or allowing the user to displace the body position.

By the way, there is a correlation between muscle metabolism and the load applied to the leg. However, in a practical sense, even when the magnitude of the load is constant, a difference in muscle metabolism often occurs due to the user's parameters such as body weight, age, gender, presence or absence of disease, kind of disease and clinical records (profile). In particular, since there are great differences between individuals with respect to the body weight, it has a strong effect on muscle metabolism. From the inventor's investigation about a relation between the load applied to one leg of the user and the muscle metabolism of a total of quadriceps femoris muscle and adductor muscle, the following results are obtained.

Figure 18:
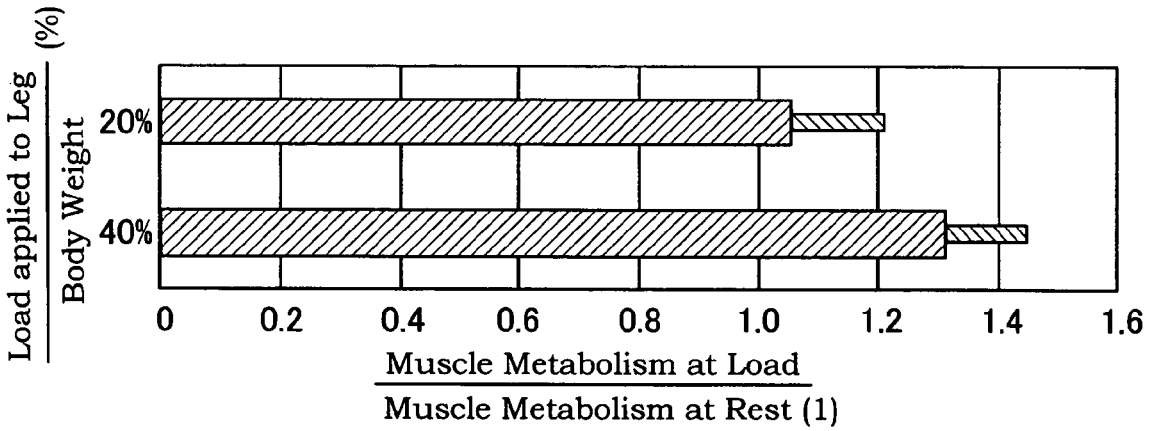
FIG. 18 is a graph showing relations between relative load and muscle metabolism.

There is a characteristic that as the metabolism increases, a reduction ratio of oxy-hemoglobin becomes larger. In accordance with the characteristic, a hemoglobin measurement was performed to evaluate muscle metabolism by means of near-infrared spectroscopy. As shown in FIG. 18, on the condition that a ratio of the load applied to one leg (i.e., the load detected by the load sensor 11) relative to the user's own weight (i.e., body weight) is 20% or 40%, the muscle metabolism was evaluated. The muscle metabolism in FIG. 18 is represented by a ratio relative to the muscle metabolism at rest. Results show that there is a significant difference in the muscle metabolism between the case of 20% and the case of 40%. In FIG. 18, a thick bar shows the muscle metabolism, and a thin bar extending from the top end of the thick bar shows fluctuations of data. Even when the fluctuations are taken into consideration, there is the significant difference therebetween. From these measurement results, when the ratio of the load applied to the leg relative to the body weight is used in place of the body weight having great differences between individuals, it can be associated with the muscle metabolism irrespective of the differences in body weight of the users.

Therefore, it is preferred that the data processing unit 12 calculates a percentage of the load detected by the load sensor 11 relative to the body weight input from the input unit 14, and indicates the percentage as the target value on the display 13. In addition, parameters other than the body weight may be input from the input unit 14. Thus, when an appropriate range of the exercise load is determined in consideration of age and gender as well as body weight, and provided on the display 13, the user can continue the exercise such that the load (the value obtained by dividing the load applied to the leg by the body weight) is kept in the appropriate range. That is, since the appropriate range of the load is recognized by the user, it is possible to avoid excess and deficiency of the load. It is preferred that a database is previously prepared with respect to the correspondence between the parameters of the user and the appropriate range of the load. In this case, when the user's parameters are input from the input unit 14, a corresponding appropriate range of the load can be automatically read out from the database. In addition, since the corresponding appropriate range of the load is indicated on the display 13 in response to the input of the user's parameters, it can be easily compared with the load detected by load sensor 11.

It is also preferred that the load applied to the leg, which is detected by the load sensor 11, and the input parameter of the user are sent to a feedback processing unit 15. The feedback processing unit 15 has a function of providing orders for operations of the motors 6 to 9 to the controller 10 such that the load applied to the leg is kept within a predetermined target range. That is, the load applied to the user's leg is controlled in a feedback manner. The target range can be appropriately determined in accordance with the user's parameters input from the input unit 14. When using the feedback processing unit 15, it is preferred that a database is previously prepared with respect to the correspondence between the parameters of the user and the target range of the load, as in the case of the data processing unit 12. In this case, when a parameter of the user is input from the input unit 14, an appropriate target range of the load can be extracted from the database. Thus, since the target range is automatically determined in accordance with the data peculiar to the user such as body weight, age, gender, presence or absence of disease, disease name and clinical records, the appropriate load can be applied to the individual user. With respect to the target load, it is desired to use the percentage of the load relative to the user's body weight. Thereby, the target range can be adequately determined irrespective of the difference between individuals.

In the case of forming the feedback processing unit 15, it is preferred that the own weight ratio is calculated by use of an output of a weight sensor (not shown) for detecting the load applied to the footplate 3, and the feedback processing unit 15 monitors the output of the weight sensor such that the own weight ratio is kept within a predetermined target range (i.e., 40 to 60%). When the own weight ratio obtained from the output of the weight sensor is out of the target range, the maximum inclination angle of the seat member 2 is changed in a feedback control manner to place the load within the target range. When the own weight ratio obtained from the output of the weight sensor is still not within the target range even though the maximum inclination angle is adjusted in an adjustable range (preferably, 3 to 5 degrees), the reciprocating cycle is controlled. In the leg training equipment of this embodiment, the saddle 22 preferably has a backrest. By use of the backrest, it is possible to prevent that the user is inclined in the backward direction, and a displacement range of the center of gravity of the user is reduced.

Figure 19:
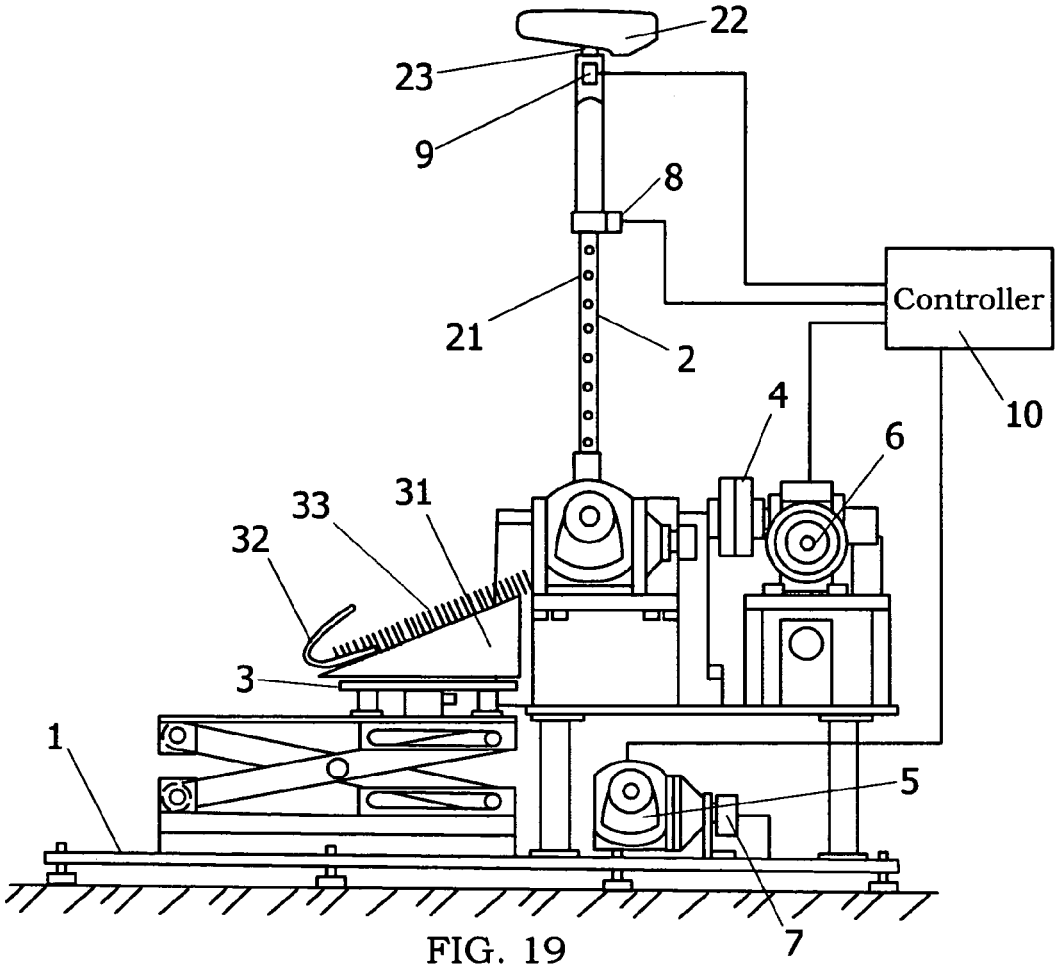
FIG. 19 is a schematic diagram of the leg training equipment according to a modification of this embodiment.

As a further modification of the leg training equipment of this embodiment, it is preferred that the top surface of the footplate 3 is formed by a downward inclination extending in the forward direction (e.g., inclined against the base by about 10 degrees), as shown in FIG. 19. In this case, the user can perform the leg training in a state that the heel is higher than the toe. This is effective to reduce the occurrence of a shear stress at knee joint. In place of using the footplate 3 having the inclined top surface, a tilting member 31 may be detachably mounted on the footplate 3 to adjust the inclination angle or the inclination direction. The numeral 32 designates a toe clip portion formed at a forward end of the tilting member 31 as a displacement preventing member. When the load is focused on the toe by the inclination of the seat member 2, the displacement of the foot can be prevented. When the displacement of the foot is prevented only at the toe, there is a fear that a large load is applied to the toe. Therefore, it is preferred to form a nonslip portion 33 for preventing slippage of the sole on the tilting member 31 as an additional displacement preventing member. Specifically, a raising portion may be formed on the top surface of the tilting member 31. Alternately, grooves or projections may be formed as the nonslip portion 33 to increase friction coefficient. In addition, the nonslip portion is preferably made of a material having a large friction coefficient such as rubber. When the foot position is fixed by the formation of the nonslip portion, it is easy to match the oscillating direction of the seat member 2 with the direction of flexion and expansion of knee joint. As a result, it is possible to prevent the occurrence of knee pain. It is not necessarily needed to incline the entire sole. For example, the toe portion may be horizontally supported without using the tilting member.

By the way, when the user has a deformed knee joint such as "knock-kneed" or "bowlegged", knee pain often happens at the time of bending the knee joint. To match the equipment with the user having knock-kneed or bowlegged tendencies, it is preferred that the top surfaces of the tilting members 31 on the left and right footplates 3 are inclined to be close to each other or spaced from each other in the left and right direction. Thereby, it is possible to reduce the knee pain caused when the user that is knock-kneed or bowlegged bends the knee joint. In addition, the tilting member 31 may be rotatably mounted to the footplate.

As another modification of this embodiment, it is preferred that the leg training equipment has a measurement unit for measuring a physiological measurement value concerning metabolism, an evaluation unit for determining the metabolism from the physiological measurement value measured by the measurement unit, and a motion control unit for controlling the equipment such that a motion pattern is changed every predetermined time period, and storing the metabolism determined by the evaluation unit together with the corresponding motion pattern. In this case, it is preferred that the evaluation unit assigns weights to the physiological measurement value by use of a weighting factor, which is a volume of muscles concerning the exercise with the leg training equipment or a volume of red muscles concerning the exercise, thereby obtaining a weighted physiological measurement value as the metabolism.

This modification is characterized by actually measuring the physiological measurement value concerning metabolism, while changing the motion pattern of the leg training equipment, extracting the motion pattern with large metabolism from the measurement results, and operating the leg training equipment according to the extracted motion pattern. The following is an explanation of the technique of extracting the motion pattern with large metabolism by use of a motion determining device shown in FIG. 20. This device has a motion control unit 60 for respectively controlling the motors (6, 7, 8, 9) of the leg training equipment. As in the case of the controller 10, a main component of the motion control unit 60 is a microcomputer. In the motion control unit 60, the motion pattern is not provided from a memory. That is, various kinds of motion patterns are generated by the motion control unit 60. The motion control unit 60 also has a function of associating the generated motion pattern with time information, and then storing. The motion pattern may be selected from a plurality of predetermined motion patterns. Alternatively, the motion pattern may be randomly generated in an acceptable range of the exercise provided by the leg training equipment.

Figure 20:
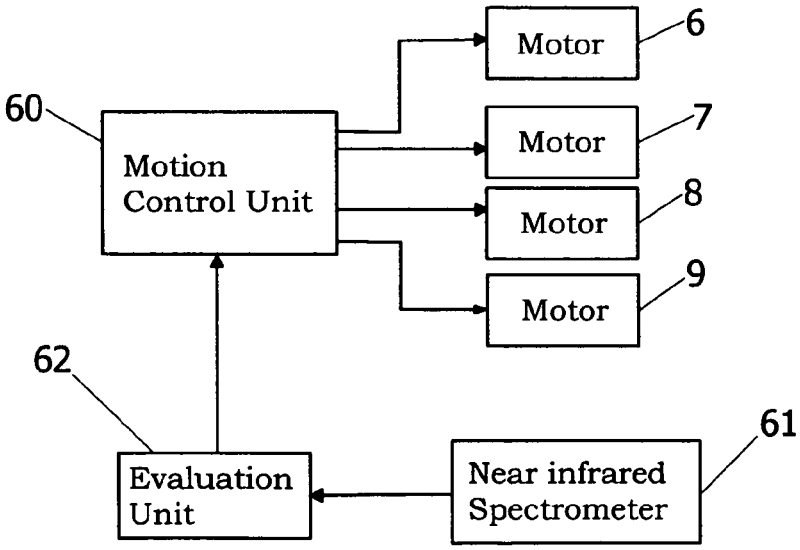
FIG. 20 is a block diagram of a motion determining device for extracting a motion pattern for large metabolism.

On the other hand, as the physiological measurement value concerning metabolism, any one of the muscle metabolism obtained by near-infrared spectroscopy and a degree of muscle contraction caused by myoelectric activity is used. The following is an explanation in the case of using the near-infrared spectroscopy. That is, as shown in FIG. 20, a near-infrared spectrometer 61 is used as the measurement unit. Near-infrared projecting and receiving probes are formed to be detachable to the femoral region. As already known, in the measurement of muscle metabolism by near-infrared spectroscopy, a change in oxygen amount (muscle metabolism) in blood is determined by use of a difference in absorption of near-infrared light between oxy-hemoglobin and deoxy-hemoglobin. Since oxygen is needed to metabolize the sugar, the muscle metabolism becomes a surrogate parameter of the sugar metabolism.

The muscle metabolism is input as the physiological measurement value in the evaluation unit 62 to determine a ratio relative to the muscle metabolism measured at rest. Since an oxygen consumption of a part of the muscles is measured by the near-infrared spectroscopy, the evaluation unit assigns weights to the muscle metabolism determined by the near-infrared spectroscopy by use of the volume of the muscles as the weighting factor, thereby estimating the metabolism of all of the muscles concerning the exercise. Since there is a correlation between the muscle metabolism and the volume of the muscles, it is needed to perform the weighting in consideration of the volume of the muscles to accurately estimate the muscle metabolism of all of the muscles concerning the exercise.

The volume of the muscles used as the weighting factor means a total volume of the muscles concerning the exercise provided by the leg training equipment. To actually measure the volume of the muscles, a large-scale device such as MRI is needed. Due to reductions in time and cost, data reported in documents may be used. For example, the volumes of femoral extensor muscles and great adductor muscles can be respectively regarded as 500 ml and 250 ml. On the assumption that the muscle metabolism per unit volume is constant, the contraction of the femoral extensor muscles is two times larger in metabolism than the contraction of the great adductor muscles. That is, to increase the metabolism, it is preferred to select the motion pattern for effectively causing the contraction of the femoral extensor muscles. Evaluation results of two kinds of motion patterns are shown in Tables 4 and 5.

TABLE 4

| | Ratio relative to "at rest" | Red muscle (volume) | Volume X Ratio |
|---|---|---|---|
| Rectus Femoris Muscle | 2.0 | 200 | 400.0 |
| Medial Vastus Muscle | 2.5 | 130 | 325.0 |
| Lateral Vastus Muscle | 3.6 | 150 | 540.0 |
| Adductor Muscle | 1.5 | 200 | 300.0 |
| Total Metabolic Degree | | | 1565.0 |

TABLE 5

| | Ratio relative to "at rest" | Red muscle (volume) | Volume X Ratio |
|---|---|---|---|
| Rectus Femoris Muscle | 1.8 | 200 | 360.0 |
| Medial Vastus Muscle | 2.0 | 130 | 260.0 |
| Lateral Vastus Muscle | 3.0 | 150 | 450.0 |
| Adductor Muscle | 3.2 | 200 | 640.0 |
| Total Metabolic Degree | | | 1710.0 |

As understood from the comparison between Tables 4 and 5, larger metabolism is obtained by the motion pattern corresponding to Table 5. Therefore, it is preferred to select the motion pattern corresponding to the Table 5 in respect of the exercise with large sugar metabolism.

As an example, a method of determining an appropriate motion pattern installed in a memory (not shown) of the leg training equipment is explained below. When a tester performs an exercise by use of the leg training equipment, which is controlled by the motion control unit, an oxygen amount in blood is simultaneously measured by means of near-infrared spectroscopy. At this time, the leg training equipment is controlled such that each of different motion patterns is performed for a required (constant) time period, and the oxygen amount measured every required time period is recorded with the start and finish times of the corresponding motion pattern. The evaluation unit assigns weights to the thus measured oxygen amount to estimate muscle metabolism of all of muscles concerning the exercise. From the motion patterns associated with the obtained muscle metabolisms, the motion pattern having the maximum muscle metabolism is selected. Consequently, the thus obtained motion pattern is installed in the memory, and actually used in the controller 10 to control the leg training equipment.

Thus, the correspondence between the motion pattern and the metabolism is investigated, and the motion pattern of the leg training equipment is determined such that the metabolism becomes an appropriate value, which is defined as a maximum value of metabolism obtained under the condition that an energy amount given to the human body by the motion pattern is constant. For example, power consumption of the leg training equipment can be used as an alternative value of the energy amount. By operating the leg training equipment according to the motion pattern provided by the motion determining device described above, it is possible to extract an exercise for more effectively enhancing the metabolism from a large number of exercises, and provide the exercise to the user.

In the case of determining a physiological measurement value from myoelectric activity, an electromyography is connected to the motion control unit in place of the near-infrared spectrometer. As the physiological measurement value, an integrated electromyography value measured for a required time period, or a ratio relative to the integrated electromyography value measured for the required time period at the maximum muscle contraction can be used. In addition, the muscle concerning sugar metabolism is mainly red muscles. Therefore, the weights are preferably assigned according to the volume of red muscles to more accurately perform the evaluation of sugar metabolism of the exercise provided by the leg training equipment.

In the motion control unit, an upper limit value of an instantaneous value of the exercise load can be set, and the motion pattern is automatically generated on the condition that the instantaneous value of the exercise load is smaller than the upper limit value. At this time, appropriate fluctuations are provided to the operation of each motor, and the motion pattern is changed in a real-time manner so as to be close to an optimum solution (i.e., such that the muscle metabolism becomes maximum within the acceptable range of the motion pattern) by using the technique of multivariate analysis or neurocomputer. According to such a control method, the motion pattern having substantially the maximum muscle metabolism can be determined in the range that is not larger than the upper limit value of the instantaneous value of the exercise load. In the above case, the motion pattern is changed in a direction of increasing the metabolism. Alternatively, it is preferred that an appropriate value of metabolism is previously set by a value other than the maximum value, and the motion pattern is converged such that the metabolism becomes close to the appropriate value.

Second Embodiment

Figure 21:
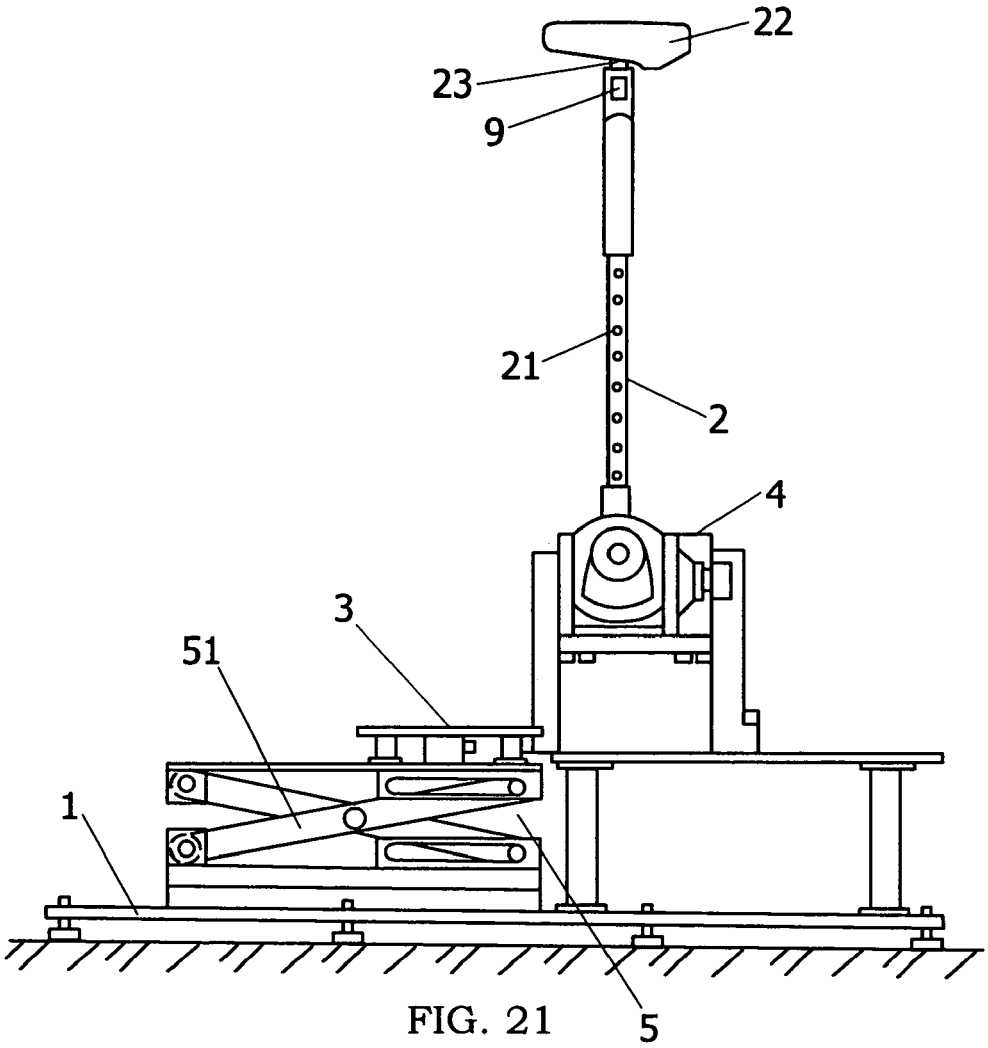
FIG. 21 is a schematic diagram of the leg training equipment according to a second embodiment of the present invention.

As shown in FIG. 21, this embodiment is directed to a leg training equipment for allowing the user to voluntarily perform a leg training without using any drive unit. That is, in the first embodiment, the motors 6 to 9 are used as the drive unit, so that the user passively receives the leg training without voluntarily performing exercises. In this embodiment, a seat member 2 and a footplate 3 are respectively coupled to a base 1 through coupling mechanisms 4, 5 without using the drive unit. The coupling mechanism 5 for coupling the footplate 3 to the base 1 provides an up and down movement of the footplate by use of a pantograph 51, as in the case of the first embodiment. As to the seat member 2, a post 21 is retractable to adjust the position of a saddle 22 in a height direction, and the saddle 22 connected to the post 21 can be inclined in a forward and backward direction about an (one) axis extending in a left and right direction. As in the case of the first embodiment, the saddle 22 can be inclined by use of a weight 25 or a ball joint 26. The pantograph 51 of the coupling mechanism 5 is used to interlock a positional change of the footplate in the height direction with an angular change of the seat member 2. The seat member 2 and the footplate 3 are mechanically interlocked by use of an appropriate combination of links and cams of the coupling mechanisms 4, 5. That is, the coupling mechanisms are formed such that the height position of the footplate 3 changes depending on a change in inclination angle of the seat member 2 against to the base 1.

In the case of using the training equipment of this embodiment, the user needs to positively (actively) move its own body. That is, when the user sitting on the saddle 22 and placing the foot on the footplate 3 applies a load to the leg such that the user's hip moves in the forward direction, the seat member 2 is inclined to the base 1, and simultaneously the footplate moves downward, so that the load applied to the leg is increased by the user's own weight without substantially causing a change in bending angle of the knee joint. The coupling mechanisms 4, 5 may have springs for recovering the original positions. Alternatively, the original positions may be recovered by leg strength of the user. The inclination direction of the seat member 2 is limited in two planes including the saddle 22 and the respective footplate 3 by the coupling mechanism 4. This means that the inclination direction of the seat member 2 (the direction of the relative positional displacement between the foot position and the position of center of gravity of the user) is limited in a direction of flexion and extension of knee joint.

Figure 22:
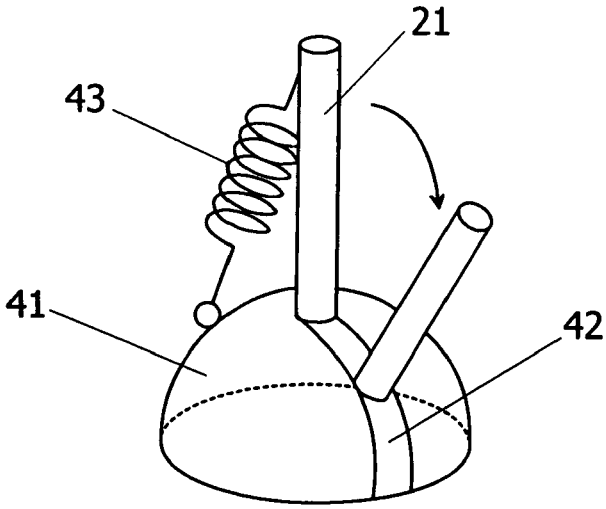
FIG. 22 is a perspective view of a coupling mechanism of the leg training equipment.

An example of the coupling mechanism 4 used in this embodiment is shown in FIG. 22. This coupling mechanism 4 has a guide member 41 of a hemispherical shape. The bottom end of the post 21 of the seat member 2 is slidably joined in a rail groove 42 formed in the guide member 41. The numeral 43 designates a return spring for providing a spring bias in a direction of returning the seat member 2 to a top position of the guide member 41. In this case, when the bottom end of the seat member 2 moves along the rail groove 42, the inclination angle of the seat member 2 increases. At this time, the top end of the seat member 2 travels along a circular path having a center of the hemispherical guide member 41. Since a larger return force is provided by the return spring 43 as the seat member 2 is inclined, the user can return the seat member 2 to the original position by a slight force. In addition, the movement direction of the seat member 2 is limited by the rail groove 42. Therefore, it is possible to apply the load to the leg without causing torsion of the knee joint by forming the rail groove 42 in a place including the direction of flexion and extension of knee joint. In FIG. 22, the rail groove 42 is formed in the single plane. When the guide member 41 is rotatably supported by the base 1, and the rotational position of the guide member 41 is adjusted such that the inclination direction of the seat member 2 is in agreement with the direction of the footplate 3, the user can apply the load to a desired one of the legs. In addition, when the guide member 41 is fixed at a stationary position, the rail grove 42 may be formed in each of two planes corresponding to the both footplates 3.

Figure 23A:
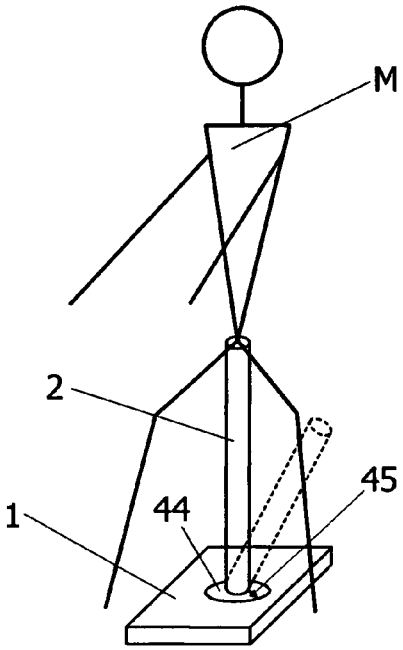
FIGS. 23A and 23B are explanatory views showing an operation of the leg training equipment.
Figure 23B:
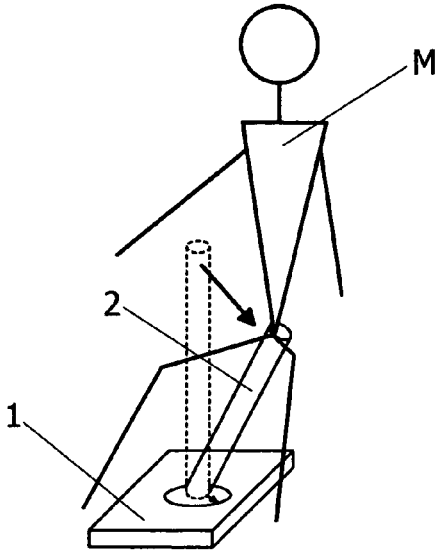

As a modification of the leg training equipment of this embodiment, the footplates 3 may be omitted. That is, as shown in FIGS. 23A and 23B, a coupling mechanism 4 is formed such that the seat member 2 can be inclined to the base 1, and the footplates 3 are omitted. Therefore, the user M sits on the saddle 22, and places the feet on the base 1 or a floor on which the base 1 is placed. When using the coupling mechanism 4 of FIG. 22, the oscillating direction of the seat member 2 can be limited. Due to the absence of the footplates 3, there is no guide for matching the foot position and the toe direction with the oscillating direction of the seat member 2. In this embodiment, the coupling mechanism 4 has a direction indicating plate 44 rotatably supported e to the base 1 in a plane parallel to the top surface of the base. On the direction indicating plate 44, an arrow mark 45 is provided. The mark 45 is in the plane including the rail groove 42 of the coupling mechanism 4 of FIG. 22. Therefore, when the foot is placed on an extension of the mark 45, it becomes easy for the user to match the oscillating direction of the seat member 2 with the direction of flexion and extension of knee joint.

For example, when the seat member 2 is inclined from the upright posture shown in FIG. 23A toward an inclined posture shown in FIG. 23B, the inclination angle of the seat member 2 is limited by the rail groove 42, so that the direction of flexion and extension of knee joint is included in the oscillating plane of the seat member 2. This figure shows that the oscillating motion of the seat member is provided in only one direction. Alternatively, the oscillating motion of the seat member 2 may be provided in two directions such that the load can be alternately applied to each of the legs. In addition, when using the coupling mechanism 4 of FIG. 22, the guide member 41 can be used as the base 1. In this case, it is preferred to dispose the direction indicating plate 44 at a periphery of the guide member 41, as described above.

Third Embodiment

Figure 24A:
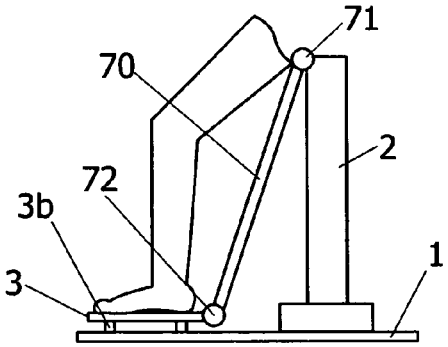
FIG. 24A is a schematic diagram of an interlock unit for a footplate and a seat member of a leg training equipment according to a third embodiment of the present invention.
Figure 24B:
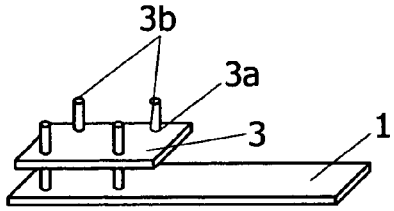
FIG. 24B is a perspective view showing a structure of the footplate.

In a leg training equipment 1 of this embodiment, a footplate 3 can be moved in only an up and down direction, and a distance between a bottom end portion of a seat member 2 and the footplate 3 is kept constant. That is, as shown in FIGS. 24A and 24B, by forming guide apertures 3*a* in four corners of a plate-like footplate 3, and inserting four guide pins 3*b* projecting on a base 1 into the guide apertures, the footplate can be moved in only the up and down direction. In this case, when a link body 70 is fixed to the seat member 2 and the footplate 3, the seat member can not be inclined against the base 1. Therefore, the link body 70 has hinges such as ball bearings at its opposite ends, which are engaged with the seat member 2 and the footplate 3, so that both of an angle between the seat member 2 and the link body 70 and an angle between the footplate 3 and the link body 70 become changeable. Thus, the footplate 3 can be moved in the up and down direction according to the oscillating motion of the seat member 2.

Figure 25:
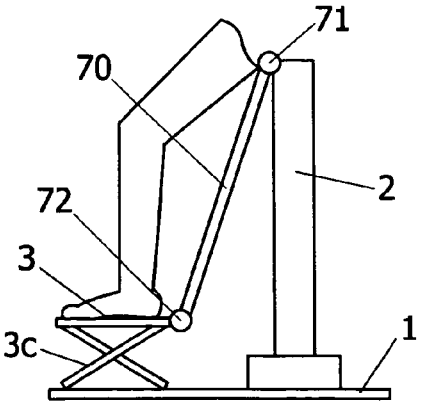
FIG. 25 is a schematic diagram of a first modification of the footplate of the leg training equipment.
Figure 26:
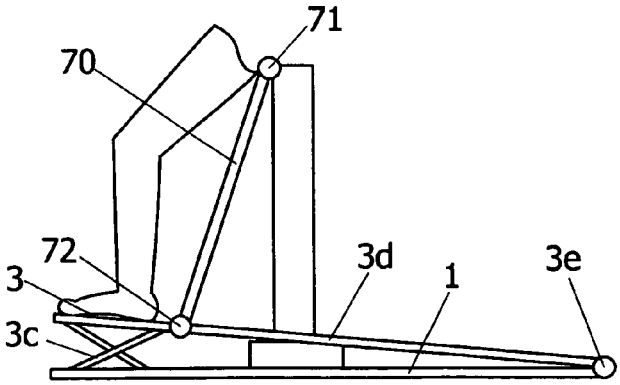
FIG. 26 is a schematic diagram of a second modification of the footplate of the leg training equipment.

The motion obtained by the components shown in FIG. 24A can be also obtained by use of components shown in FIG. 25. That is, the footplate 3 is mounted on the base 1 through a pantograph 3*c* that is retractable in the up and down direction. In addition, as shown in FIG. 26, it is preferred that a link 3*d* is pivotally supported at a backward position of the user by a hinge 3*e*, and the footplate 3 is formed at a forward end of the link. In this case, the lower end of the link body 70 is coupled to a forward portion of the link 3*d* through a hinge 72. When the link 3*d* is a rigid body, and has a sufficient length such that the footplate 3 can be moved substantially in the up and down direction, the movement of the user's foot is limited in the up and down direction, as in the case of FIGS. 24A and 25.

Figure 27:
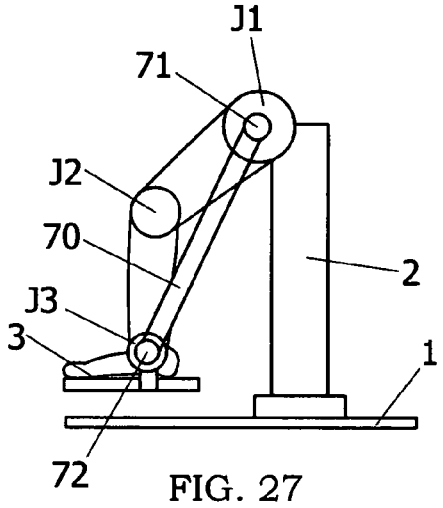
FIG. 27 is a schematic diagram of a third modification of the footplate of the leg training equipment.

In the above components of this embodiment, as shown in FIG. 27, it is preferred that hinges 71, 72 provided at the opposite ends of the link body 70 are respectively disposed at a side of a hip joint J2 and a side of a foot joint J3. That is, the hinge 71 is located at a higher position than the saddle provided at the top end of the seat member 2, and the hinge 72 is located at a higher position than a top surface of the footplate 3. To prevent the occurrence of positional displacements between the hip joint J2 and the hinge 71 and between the foot joint J3 and the hinge 72; a restraint member such as belt may be used for the saddle and the footplate 3. In addition, it is desired that the movement direction of the footplate 3 is limited in the up and down direction to prevent the occurrence the positional displacements described above. The other components and their functions are the same as the first embodiment.

Figure 28:
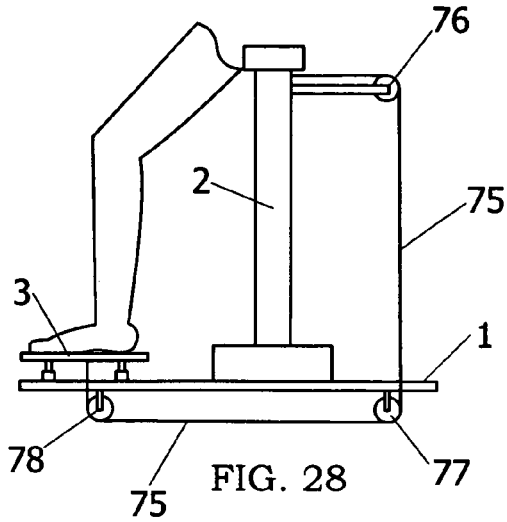
FIG. 28 is a schematic diagram of a fourth modification of the footplate of the leg training equipment.

As a further modification of this embodiment, as shown in FIG. 28, it is preferred to use a wire 75 in place of the link body 70, and form a movement restricting portion for limiting the movement of the footplate 3 in the up and down direction. The wire 75 is used to connect a top end portion of the seat member 2 with a required position of the footplate 3 through a plurality of pulleys 76 to 78. Those pulleys are disposed such that the wire extends from the backside of the seat member 2 to the bottom side of the footplate 3. In the figure, the wire 75 extending backward from the top end portion of the seat member 2 is placed on the pulley 76 to change the course of the wire in the downward direction, and then placed on the pulley 77 to change the course of the wire in the forward direction. Finally, the wire 75 is placed on the pullet 78 to change the course of the wire in the upward direction, and then connected to the footplate 3. In this case, when the seat member 2 is inclined from an upright posture against the base 1 toward a forward left direction or a forward right direction, the wire between the seat member 2 and the pulley 76 vibrates in the left and right direction. Therefore, the pulley 76 is preferably disposed such that the vibration of the wire is permissible. The pulleys 76, 77 may be replaced by a single pulley.

In the above case, when the seat member 2 is inclined toward the left side of the drawing, the footplate 3 is moved downward by a tensile force of the wire 75. On the other hand, when the seat member 2 is returned from the inclined posture to the upright posture, an upward movement of the footplate 3 can not be obtained by the above-described components. In such a case, an additional component for moving the footplate 3 upward is needed. For example, it is preferred that an elastic member is disposed between the footplate 3 and the base 1 to provide a spring force against the load applied downward to the footplate 3. The other components and their functions are the same as the first embodiment.

Figure 29:
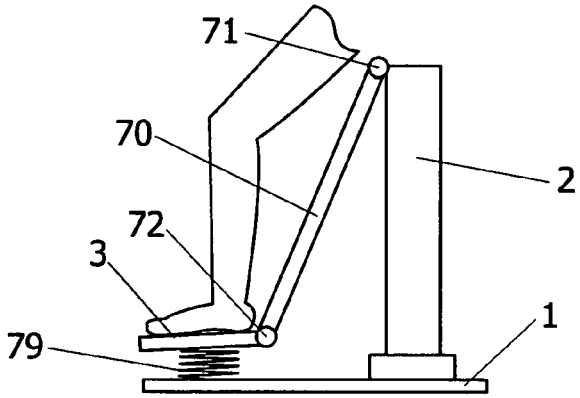
FIG. 29 is a schematic diagram of a fifth modification of the footplate of the leg training equipment.

As another modification of this embodiment, as shown in FIG. 29, a return spring 79 is disposed as the elastic member between the base 1 and the footplate 3. In this case, when the load is applied downward to the footplate 3, the return spring 79 provides a spring force against the load to the footplate 3. Therefore, when the seat member 2 is returned from the inclined posture to the upright posture, the spring force of the return spring 79 effectively acts on the seat member 2 through the link body 70. In place of the return spring 79, another elastic member such as urethane foam may be used.

Fourth Embodiment

Figure 30A:
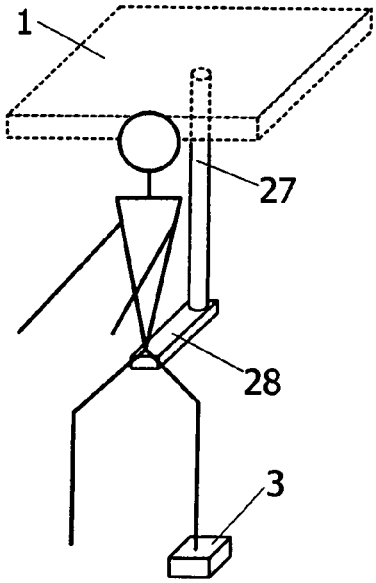
FIGS. 30A and 30B are explanatory views showing an operation of a leg training equipment according to a fourth embodiment of the present invention.
Figure 30B:
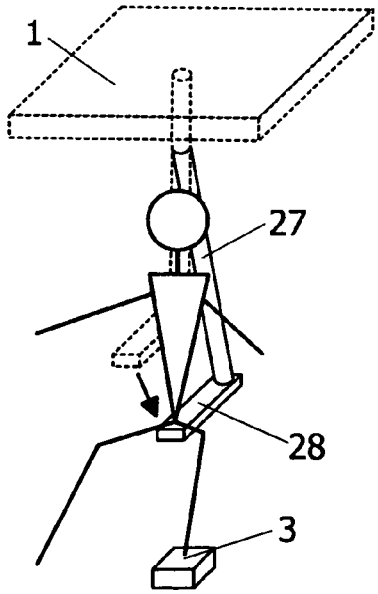

As shown in FIGS. 30A and 30B, a leg training equipment of this embodiment is characterized by using a seat 28 hung down from a base 1 through an arm 27 that is the support portion for supporting the user. By appropriately designing a coupling mechanism (not shown) between the base 1 and the arm 27, the seat 28 corresponding to the saddle can be moved, as in the case of the above-described embodiments. In the drawings, the arm 27 is pivotally supported at its top end by the base 1, so that the seat 28 can be moved in a pendulum manner. In this case, a movement direction of the seat 28 is limited in a direction of flexion and extension of knee joint of the user. Therefore, on the condition that the foot position and the toe direction of the user M are determined by use of a footplate 3, a direction of the relative positional displacement between the foot position and the position of center of gravity of the user M is limited to the direction of flexion and extension of knee joint.

Figure 31:
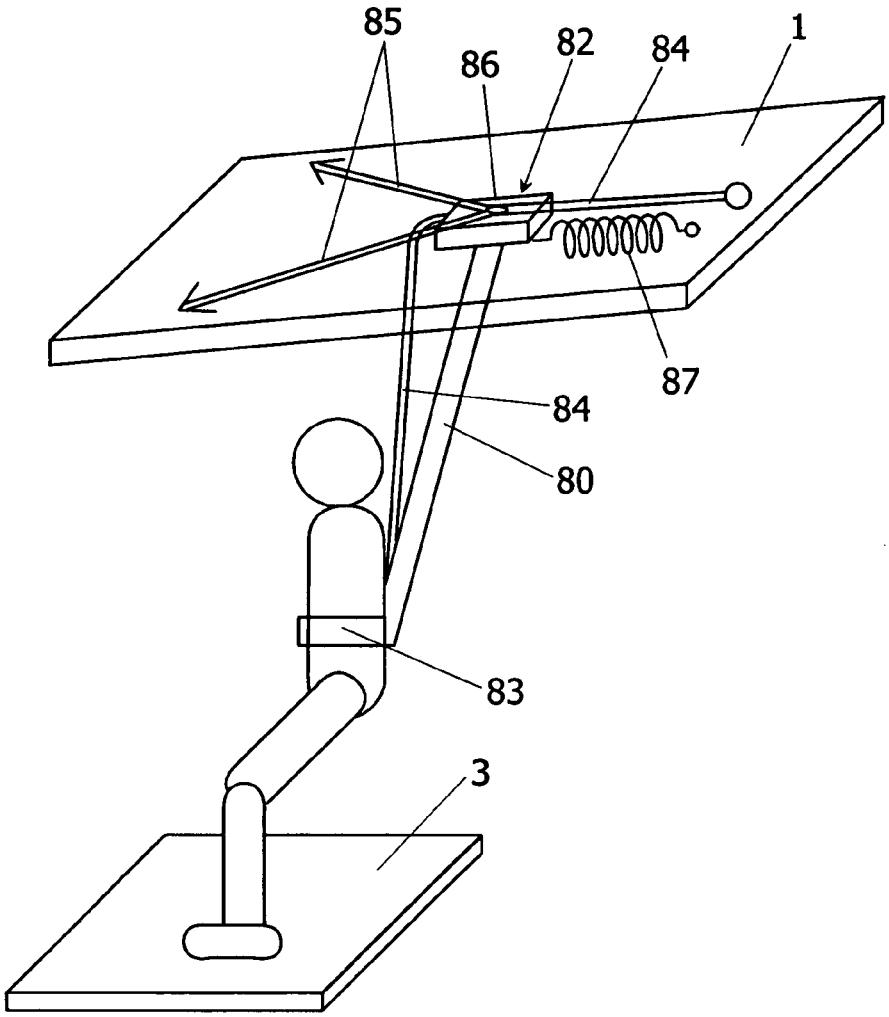
FIG. 31 is a schematic diagram of the leg training equipment according to a modification of this embodiment.

As a modification of this embodiment, as shown in FIG. 31, the equipment has a body holding unit 80 for holding the user's body in a hanging manner and a footplate 3 on which the user's foot is placed. The body holding unit 80 is movably coupled to a forward tilted base (top panel) 1 through a coupling mechanism 82. The body holding unit 80 has a waist holding member 83 retractable to hold the user's waist at its one end, and a wire 84 having a required length, which is connected at its one end with an end of the waist holding member 83 and fixed at the opposite end to the top plate 1. The other one end of the waist holding member 83 is slidably supported along a Y-shaped guide rail 85 formed in the top plate 1 by use of a slider 86.

In this leg training equipment, when a slide movement of the user supported by the body holding unit 80 is provided in the forward direction of the forward tilted base 1, an amount of the wire 84 extending downward from the base 1 is reduced to move the user upward. In this case, as a distance of the slide movement of the user in the forward direction increases, a movement distance of the user in the upward direction becomes large. By the way, a spring 87 is disposed such that one end of the spring is fixed to the slider 86 and the other end is fixed to a required position of the base 1. A length of the spring increases by the forward movement of the user. Therefore, as the user is moved in the forward direction, a restoring force of the spring 87 works in a (backward) direction of returning the user to the initial position. At this time, the amount of the wire 84 extending downward from the base 1 increases to move the user downward. By appropriately designing the path of the guide rail 85, and suitably determining the foot position of the user on the footplate 3, it is possible to limit the relative positional displacement between the foot position and the position of center of gravity of the user in the direction of flexion and extension of knee joint.

In the above components of FIG. 31, it is assumed that the footplate 3 is a stationary footplate. However, the footplate 3 may be movable in at least one of the horizontal direction and the vertical direction. In addition, an interlock unit for moving the footplate 3 in synchronization with the motion of the body holding unit 80 may be used. This embodiment is directed to the leg training apparatus for allowing the user to actively perform the leg training in a state that the user's foot is placed on the footplate 3. However, by use of a drive unit for providing an oscillating motion of the body holding unit 80, it is possible to obtain the leg training apparatus for providing the leg training to the user in a passive manner. In addition, when the footplate 3 is movable, it is preferred to use an auxiliary drive unit for driving the footplate in addition to the drive unit for providing the oscillating motion of the body holding unit, and a controller for controlling these drive units in a synchronous manner. In this case, it is possible to provide more effective leg training to the user.

Fifth Embodiment

Figure 32:
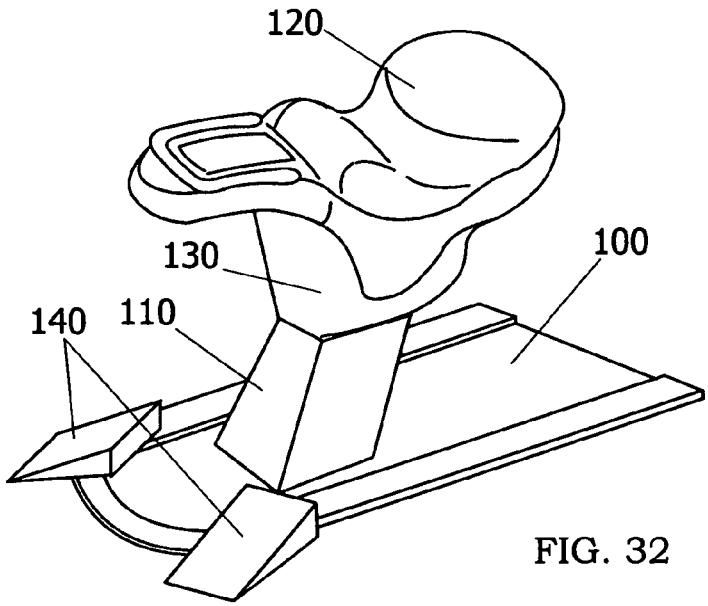
FIG. 32 is a schematic perspective view of a leg training equipment according to a fifth embodiment of the present invention.

As shown in FIG. 32, a leg training equipment of this embodiment is composed of a base 100, a columnar support 110 fixed to the base, a seat 120 for supporting a user's hip, a coupling mechanism 130 disposed between the columnar support and the seat, and a pair of footplates 140 fixed at a forward side of the columnar support.

Figure 33A:
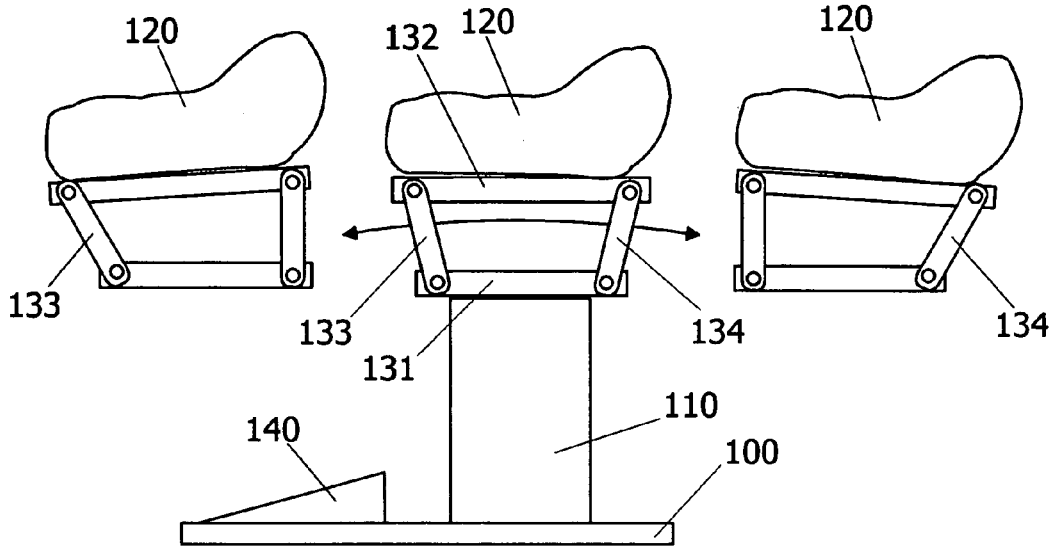
FIG. 33A is an explanatory view showing an operation of a coupling mechanism of the leg training equipment.

The coupling mechanism 130 for providing an oscillating motion of the seat 120 has the capability of providing a reciprocating linear movement in a forward and backward direction, reciprocating pivotal movement (pitching) about an axis extending in a left and right direction, and a reciprocating pivotal movement (rolling) about an axis extending in the forward and backward direction. As shown in FIG. 33A, the coupling mechanism is formed with a fixed plate 131 fixed to the columnar support 110, a movable plate 132 for carrying the seat 120 thereon and disposed above the fixed plate, and two pairs of links (133, 134) used to couple front and rear ends of the movable plate 132 to the corresponding ends of the fixed plate 131. The links 133, 134 are pivotally coupled to the fixed plate 131 and the movable plate 132 about the axis extending in the left and right direction.

A horizontal distance between the position of coupling the link 133 to the fixed plate 131 and the position of coupling the link 134 to the fixed plate 131 is determined to be smaller than the horizontal distance between the position of coupling the link 133 to the movable plate 132 and the position of coupling the link 134 to the movable plate 132. Therefore, when the seat is moved toward the right side (rearward direction) of FIG. 33A, it takes an inclined posture that the front end of the movable plate 132 is slightly higher than the rear end. When the seat is in the center position of FIG. 33A, it takes a substantially horizontal posture. In addition, when the seat is moved toward the left side (forward direction) of FIG. 33A, it takes an inclined posture that the front end of the movable plate 132 is slightly lower than the rear end. A top surface of the seat 120 is not necessarily formed to be parallel with the movable plate 132. For example, the top surface of the seat may be formed to have a substantially horizontal surface when the seat is moved toward the right side (rearward direction) of FIG. 33A. Although it is not shown in the drawing, an output of a drive unit can be transmitted to the movable plate 132 through a power transmission mechanism such as cam and crank.

Figure 33B:
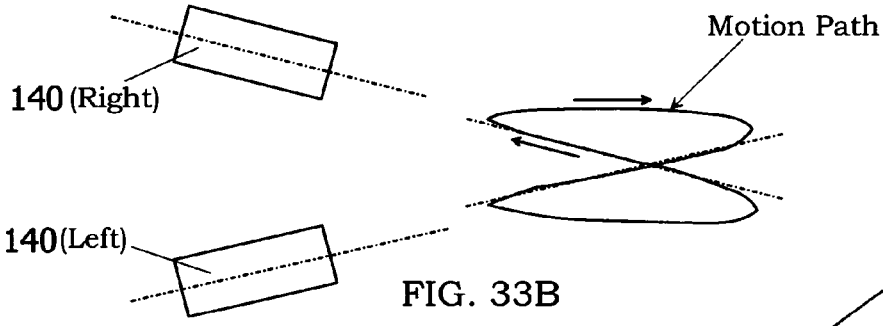
FIG. 33B is a diagram showing footplate positions and a motion path provided by the coupling mechanism.

On the other hand, each of the footplates 140 has a top surface inclined toward the forward end (toe direction) by about 10 degrees. In addition, when the footplate 140 receives the load from the above, it can be moved in the downward direction by a distance of about 20 to 30 mm by use of a built-in spring (not shown). Furthermore, the left and right footplates 140 are not placed in parallel to each other. As shown in FIG. 33B, they are disposed such that their axial lines intersect to each other by a required angle. The intersecting angle of the footplates is determined to be in agreement with the intersecting angle of a motion path provided by the coupling mechanism. In this embodiment, the motion path has substantially a figure of eight when observed from above. In addition, the left side of FIG. 33B corresponds to the forward side of the leg training equipment. An axial direction of the right footplate is substantially parallel to an exercise direction during a period that the coupling mechanism provides the motion in a forward right direction. Similarly, an axial direction of the left footplate is substantially parallel to the exercise direction during a period that the coupling mechanism provides the motion in a forward left direction.

By the way, there is a reason for that damage does not occur at the knee joint even though the human's leg receives a large acceleration of more than 1 G at the time of walking or running. It is because as the load increases, muscle contraction is caused at the circumference of the knee joint, so that the knee joint is fixed, and the occurrence of shear force at the knee joint is reduced. In the leg training equipment of the present invention utilizing this mechanism, the center of gravity of the user is displaced in the extension direction of the knee joint during a period that the load applied to the leg increases. That is, by matching the motion path provided by the coupling mechanism to the extension direction of the knee joint in at least a forward movement period (i.e., a period that the load applied to the leg increases), it is possible to reduce the shear load applied to the knee joint. After the maximum load is applied to the leg, it is not always needed to match the motion path provided by the coupling mechanism with the extension direction of the knee joint because the muscle contraction is sufficiently caused at the circumference of the knee joint to fix the knee joint. In addition, the coupling mechanism 130 may limit the movement direction in only the forward and rearward direction.

Sixth Embodiment

Figure 34B:
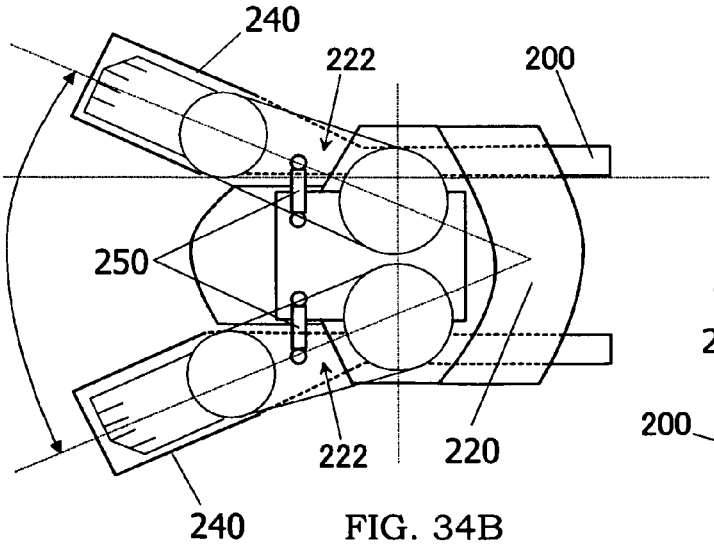
FIGS. 34A and 34B are schematic side and top views of a leg training equipment according to a sixth embodiment of the present invention.
Figure 34A:
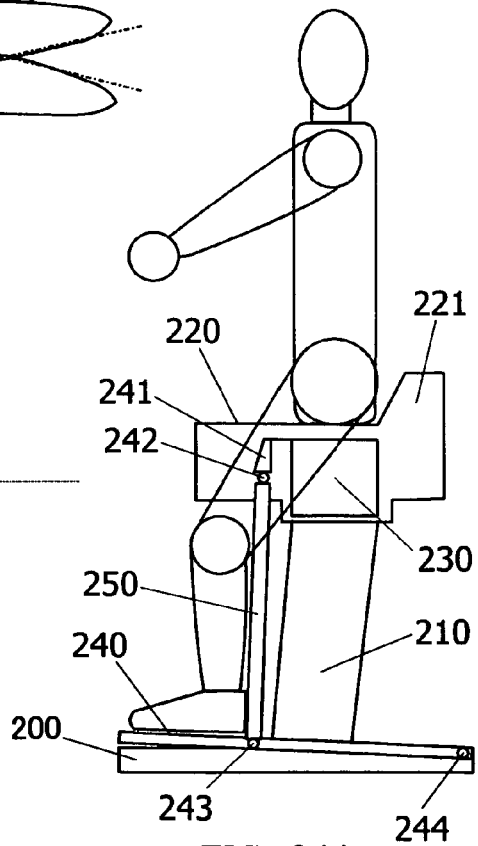

As shown in FIGS. 34A and 34B, a leg training equipment of this embodiment is mainly composed of a base 200, a columnar support 210 movably supported to the base and accommodating a drive unit therein, a seat 220 for supporting a user's hip, a coupling mechanism 230 for coupling between the seat and the columnar support, a pair of footplates 240 disposed at a forward side of the columnar support, and a link 250 extending between the seat and the footplates.

Figure 35A:
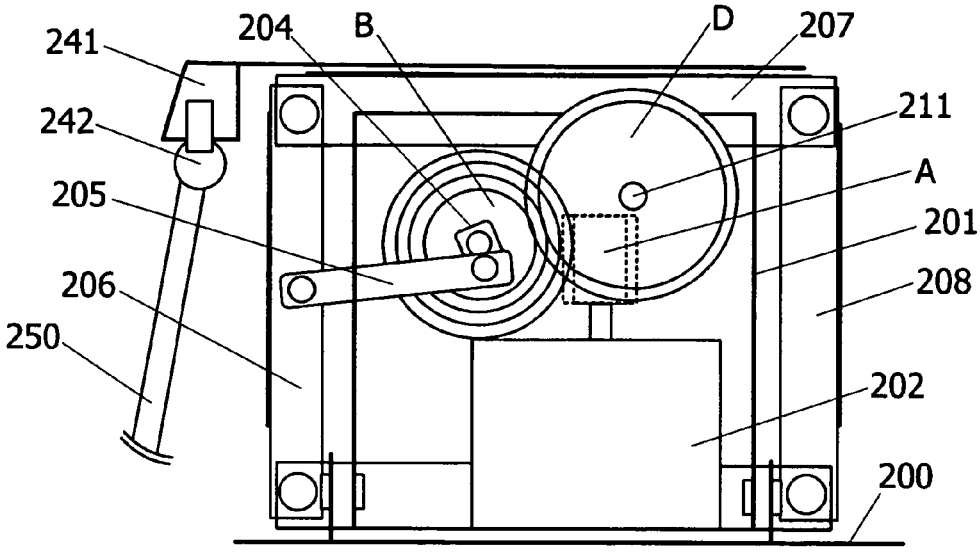
FIGS. 35A to 35C are schematic side, top and front views of a drive unit of the leg training equipment.
Figure 35B:
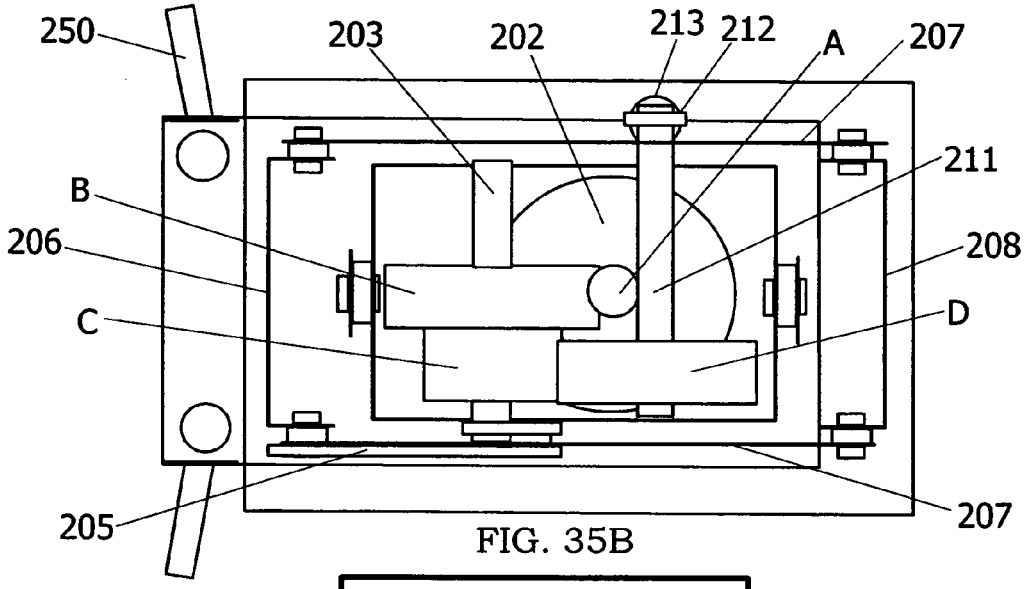
Figure 35C:
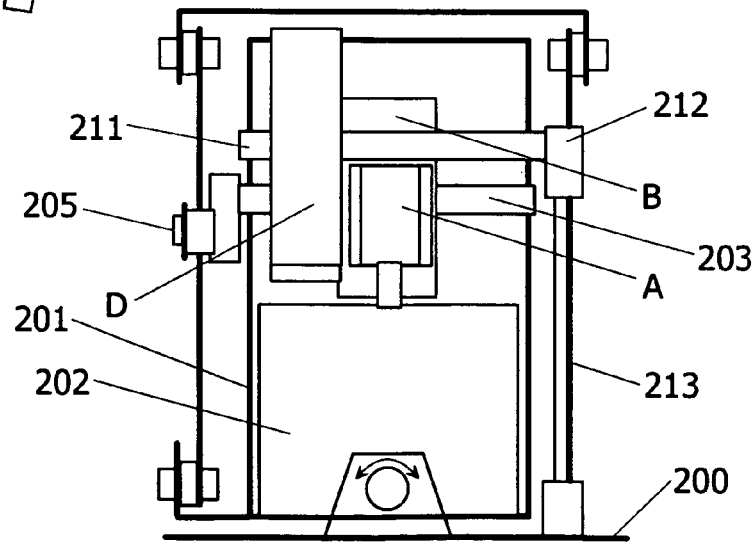

As shown in FIGS. 35A to 35C, the drive unit is accommodated in a gear box 201, which is placed in the columnar support 210 and pivotally supported in a left and right direction by the base 200. A shaft 203 is rotatably supported in the gear box 201, and a gear A mounted on a rotational shaft of the motor 202 is engaged to a reduction gear B mounted on the shaft 203. The rotation of the shaft 203 provided through the reduction gear B is transmitted to frames 206, 207, 208 through an eccentric cam 204 and a coupling plate 205, so that the seat 220 is moved forward and backward and up and down. On the other hand, a gear C mounted on the shaft 203 is engaged to a gear D mounted on a shaft 211, so that the rotational speed of the shaft 203 is reduced to half, and then transmitted to shaft 211. The rotation of the shaft 211 is transmitted to an arm 213 through an eccentric cam 212. This arm 213 is universally joined to the base 200, so that the seat 220 can be moved in the left and right direction, as shown by the arrows in FIG. 35C. At each of coupling portions, a bearing is used to achieve a wobbly free structure. In a motion path of the drive unit, a stroke in the left and right direction is substantially a half of the stroke in the forward and rearward direction, and the oscillating motion in the left and right direction is obtained at the reduction gear ratio of 1/2. By appropriately changing phase differences of the eccentric cams 204, 212, the motion path of the seat obtained from above may be configured in a V shape, W shape or a figure of horizontal eight.

On the other hand, the left and right links 250 are coupled to an attachment member 241 fixed to the frame 207 through joints 242. Each of the footplates 240 is movably supported in the up and down direction by use of the link 250, a joint 243 and a fulcrum 244. In this case, the motion path of the footplate is formed such that when the oscillating motion of the seat is provided in a forward, right and downward direction, the right footplate 240 is subserviently moved in the downward direction, and when the oscillating motion of the seat is provided in the forward, left and downward direction, the left footplate 240 is subserviently moved in the downward direction. Thereby, the relative positional displacement between the foot position and the position of center of gravity of the user can be limited in the direction flexion and extension of knee joint. When it is needed to simultaneously move both of the left and right footplates in the downward direction, the positions of the left and right joints 242 are displaced toward the centerline between left and right. In addition, it is preferred that each of the footplates are movably supported by use of a spring member, and spring characteristics of the spring member are determined such that a distance of the downward movement of the footplate is obtained to be equal to the distance of the downward movement of the seat 220 by the load corresponding to a substantially half of the user's weight.

Figure 36A:
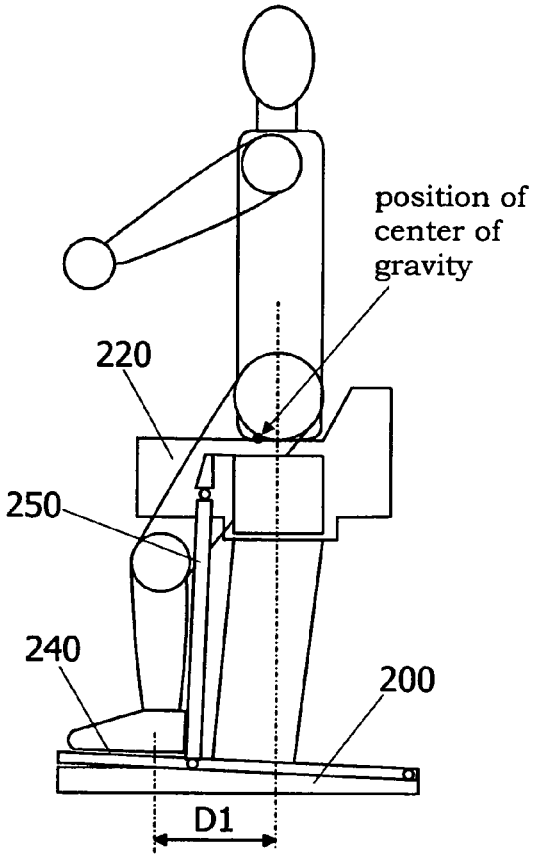
FIGS. 36A and 36B are explanatory views showing an operation of a seat position adjuster for the users having different body heights.
Figure 36B:
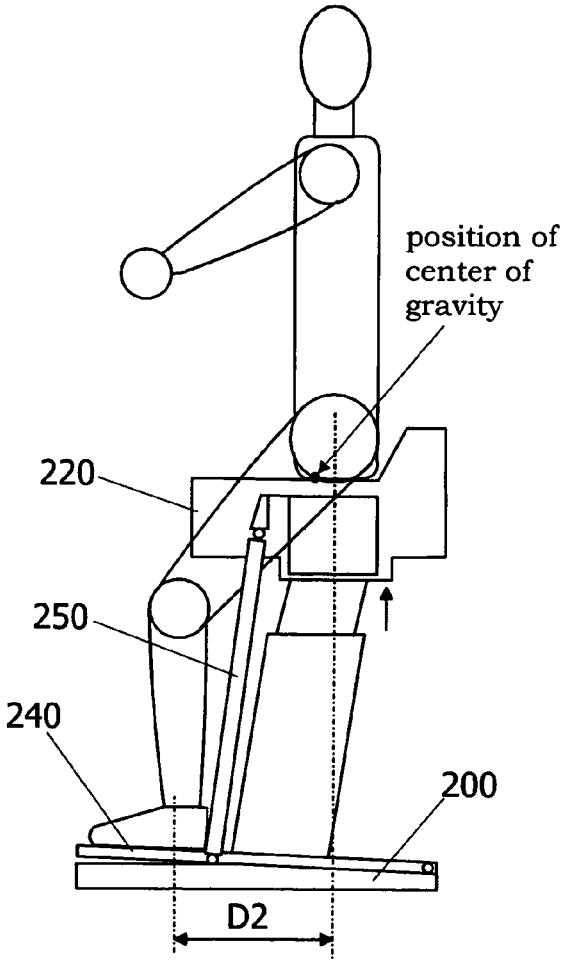

As shown in FIG. 34B, the seat 220 has a projection 221 for receiving the user's hip and waist and recesses 222 formed at its forward left and right portions, into which the femoral regions of the user in the sitting posture are fitted. Thereby, even when the oscillating motion of the drive unit is provided in the forward, downward, left and right directions, the user's hip and waist can be pushed forward by the projection 221 without slippage, and also the user can hold on the footplate, so that the load can be effectively applied to the femoral region. As shown in FIGS. 36A and 36B, a height of the seat is adjustable depending on body height or sitting height of the user. Since a horizontal distance between the foot position on the footplate and the hip position on the seat is increased (D1→D2) as the seat position is higher, it is possible to provide an appropriate leg training to the users having different body heights.

The exercise provided by the above leg training equipment is not for the purpose of simply shaking the user. When the user is shaken, it tries to change the head position for balance or insure itself against shaking, thereby allowing the user to performs an exercise with muscle tension. This exercise applies the load to the muscles of the hip and the femoral region of the user, so that muscle strength of both of the body and the legs or metabolism (blood flow, lymph flow) can be improved. In addition, since the relative positional displacement between the foot position and the position of center of gravity of the user is limited in the direction of flexion and extension of knee joint, the user having knee pain can perform the leg training with a safe conscience.

Figure 37:
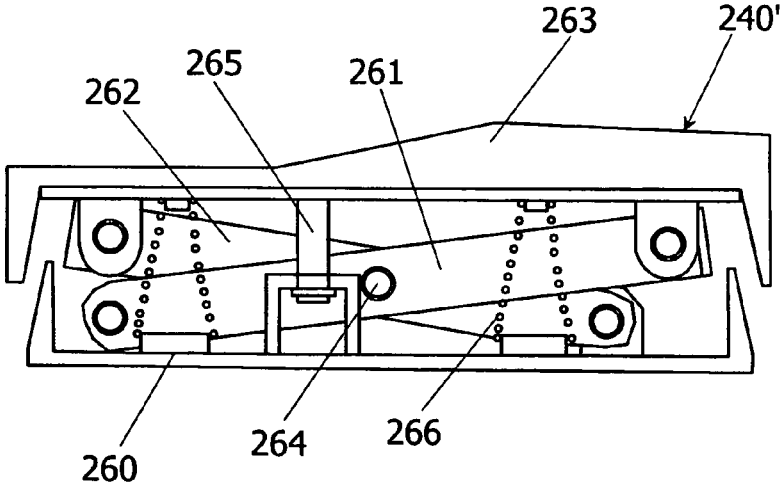
FIG. 37 is a schematic diagram showing a modification of the footplate of the leg training equipment.

As a modification of this embodiment, a footplate 240' shown in FIG. 37 may be used. In this footplate, each of first and second movable plates (261, 262) is pivotally supported to each of a base 260 and a step board 263. In addition, the first and second movable plates (261, 262) are movably coupled to each other by use of a pin 264. On the other hand, the base 260 is connected to the step board 263 by a pin 265. Springs 266 are disposed between the base 260 and the step board 263. Thus, by use of the footplate obtained by coupling the pair of movable plates (261, 262) in a cross shape, it is possible to provide a uniform downward movement of the footplate regardless of the foot position on the footplate 240'.

The coupling mechanism of the present invention is essential to movably couple the support portion to the base such that the load applied to the leg by the user's own weight changes by the relative positional displacement between the foot position and the position of center of gravity of the user, and to limit a movable direction of the support portion such that at least when the load applied to the leg increases, a direction of the relative positional displacement between the foot position and the position of center of gravity is substantially limited to the direction of flexion and extension of knee joint. On the condition that the user sits on the seat member 2, the center of gravity of the user is located at slightly forward position of the user's hip. Therefore, the position of the center of gravity can be regarded as "a slightly forward position of the center of the seat member". In this case, in the coupling mechanism of the seat-type leg training equipment shown in FIGS. 36A and 36B, the support portion is movably supported to the base such that the load applied to the leg by the user's own weight changes by the relative positional displacement between the foot position and "the slightly forward position of the center of the seat member", and a movable direction of the support portion is limited such that at least when the load applied to the leg increases, a direction of the relative positional displacement between the foot position and "the slightly forward position of the center of the seat member" is substantially limited to the direction of flexion and extension of knee joint.

INDUSTRIAL APPLICABILITY

As described above, according to the leg training equipment of the present invention, a relatively light load can be applied to the leg including the femoral region in a state of supporting a part of the user's body weight by the support portion, so that a muscle contraction of the femoral region can be effectively caused to enhance sugar metabolism. Therefore, it is possible to provide an appropriate leg training to the users who show a reduction in exercise capacity due to arthritic pain or deterioration in muscle strength.

In addition, the leg training equipment of the present invention substantially limits the direction of the relative positional displacement between the foot position and the position of center of gravity in the direction of flexion and extension of knee joint. This means that a direction of applying the load can be limited in a direction of connecting the center of knee and the second toe. When the load is applied in this direction, the user having knee pain such as osteoarthritis of the knee joint can safely perform the leg training without clinical deterioration or knee pain.

Thus, the present invention is expected to be widely used as an exercise assist device suitable for the purpose of prevention/improvement of lifestyle-related diseases, or beauty/dieting exercises as well as the equipment for providing an appropriate leg training to the users having knee diseases or needing rehabilitation exercises for legs.

The invention claimed is:

1. A leg training equipment comprising:

a base fixed in place;

a support portion configured to support a part of a user's body such that at least a part of the user's own weight acts on a leg of the user including a femoral region, and configured to be movable relative to said base such that a load applied to the leg by the user's own weight changes by a relative positional displacement between a foot position and a position of center of gravity of the user;

a drive unit configured to move said support portion; and a coupling mechanism configured to couple said support portion, and configured to limit a movable direction of said support portion such that at least when the load applied to the leg increases, a direction of the relative positional displacement between the foot position and the position of center of gravity is substantially limited to a direction of flexion and extension of the user's knee joint, wherein said support portion is configured to be at least inclinable or slidable diagonally forward relative to said base.

2. The leg training equipment as set forth in claim 1, wherein said support portion comprises a footplate, on which the user's foot is placed.

3. The leg training equipment as set forth in claim 2, wherein said footplate is coupled to said base through said coupling mechanism so as to be movable relative to said base in at least one of horizontal and vertical directions.

4. The leg training equipment as set forth in claim 3, wherein said coupling mechanism comprises an elastic member disposed at a bottom side of said footplate.

5. The leg training equipment as set forth in claim 1, wherein said supporting portion comprises a support means configured to support the user in a sitting posture.

6. The leg training equipment as set forth in claim 5, wherein said support means comprises a seat member configured to support a hip of the user, and said seat member is movably coupled in an oscillating manner to said base through said coupling mechanism.

7. The leg training equipment as set forth in claim 6, wherein the drive unit is configured to move said seat member in the oscillating manner.

8. The leg training equipment as set forth in claim 6, wherein said seat member comprises a post coupled to said base through said coupling mechanism, a saddle disposed at a top end of said post to support the hip of the user, and a joining means configured to join said saddle with said post to provide at least one of a parallel movement and a rotational movement of said saddle in a plane intersecting with an axial direction of said post.

9. The leg training equipment as set forth in claim 8, wherein said joining means movably supports said saddle to said post in a seesaw fashion.

10. The leg training equipment as set forth in claim 8, wherein said joining means slidably supports said saddle so that said saddle is moved repeatedly in the plane intersecting the axial direction of said post.

11. The leg training equipment as set forth in claim 10, comprising a saddle drive unit configured to provide a slide movement of said saddle relative to said post.

12. The leg training equipment as set forth in claim 8, wherein said post is retractable in its longitudinal direction, and the leg training equipment comprises a post drive unit configured to provide extension and contraction of said post.

13. The leg training equipment as set forth in claim 8, wherein said post is retractable in its longitudinal direction, and the leg training equipment further comprises a footplate on which the user's foot is placed, and a control unit configured to control a first drive unit configured to move said seat member in the oscillating manner in synchronization with at least one of a second drive unit configured to drive said footplate, a third drive unit configured to provide extension and contraction of said post, and a fourth drive unit configured to provide a slide movement of said saddle so that said saddle is moved repeatedly in the plane intersecting the axial direction of said post.

14. The leg training equipment as set forth in claim 1, wherein said support portion comprises a support means configured to support the user in a hanging posture.

15. The leg training equipment as set forth in claim 14, wherein said support means comprises a body holding unit configured to hold the user's body in the hanging posture and movably coupled in an oscillating manner to said base through said coupling mechanism, and a footplate on which the user's foot is placed, and wherein the leg training equipment further comprises an interlock unit configured to provide a motion of said footplate in synchronization with the oscillating motion of said body holding unit.

16. The leg training equipment as set forth in claim 15, wherein said body holding unit comprises a waist holding member configured to hold the user's waist, and a hanging member for the user configured to be retractable in its axial direction.

17. The leg training equipment as set forth in claim 15, wherein the drive unit is configured to move said body holding unit in an oscillating manner.

18. The leg training equipment as set forth in claim 15, comprising a first drive unit configured to move said body holding unit in an oscillating manner, a second drive unit configured to move said footplate, and a control unit configured to control the first drive unit and the second drive unit in a synchronous manner.

19. The leg training equipment as set forth in claim 1, wherein said coupling mechanism limits the movable direction of said support portion such that a distance between the foot position and a hip position of the user is kept substantially constant.

20. The leg training equipment as set forth in claim 1, wherein said support portion comprises a seat member configured to support a hip of the user and coupled to said base through said coupling mechanism, and a footplate on which the user's foot is placed, and said drive unit is configured to oscillate said seat member relative to said base, and the leg training equipment further comprises an interlock unit configured to provide a motion of said footplate in synchronization with the oscillating motion of said seat member.

21. The leg training equipment as set forth in claim 20, further comprising a first drive unit configured to move said seat member in the oscillating manner, a second drive unit configured to move said footplate, and a control unit configured to control the first drive unit and the second drive unit in a synchronous manner.

22. The leg training equipment as set forth in claim 21, wherein said control unit controls the motions of said seat member and said footplate to provide a reciprocating oscillating motion of said seat member between a position where said seat member is in an upright posture against said base and a position where said seat member is in an inclined posture against the upright posture by an angle of 5 degrees or less, so that a knee angle of the user is kept at 40 degrees or less, and a reciprocating number per second of the reciprocating oscillating motion of said seat member is 2 or less.

23. The leg training equipment as set forth in claim 20, wherein said interlock unit provides the motion of said footplate in synchronization with the oscillating motion of said seat member such that a bending angle of the knee joint of the user is in a range of 45 degrees or less when the position of center of gravity of the user is changed under a condition that the user sits on said seat member and places the foot on said footplate.

24. The leg training equipment as set forth in claim 20, wherein said interlock unit provides the motion of said footplate in synchronization with the oscillating motion of said seat member such that a bending angle of the knee joint of the user is kept substantially constant when the position of center of gravity of the user is changed.

25. The leg training equipment as set forth in claim 20, wherein said interlock unit selectively provides a first exercise mode where the motion of said footplate is provided in synchronization with the oscillating motion of said seat member such that a bending angle of the knee joint of the user is in a range of 45 degrees or less when the position of center of gravity of the user is changed under a condition that the user sits on said seat member and places the foot on said footplate, and a second exercise mode where the motion of said footplate is provided in synchronization with the oscillating motion of said seat member such that the bending angle of the knee joint of the user is kept substantially constant when the position of center of gravity of the user is changed, and wherein the leg training equipment comprises a selector configured to select one of the first exercise mode and the second exercise mode.

26. The leg training equipment as set forth in claim 1, further comprising a measurement unit configured to measure a physiological measurement value concerning metabolism, an evaluation unit configured to determine the metabolism from an output of said measurement unit, a load applying unit configured to apply a load to the user, and a control unit configured to control a magnitude of the load to be applied to the user by said load applying unit according to the metabolism provided from said evaluation unit.

27. The leg training equipment as set forth in claim 26, wherein said evaluation unit assigns weights to the physiological measurement value by use of a weighting factor, which is one of a volume of muscles for an exercise provided by said load applying unit and a volume of red muscles for said exercise, thereby obtain a weighted physiological measurement value as the metabolism.

28. The leg training equipment as set forth in claim 1, comprising a load sensor provided on said support portion to detect a load applied to the leg relative to the user's own weight, and a load-change informing unit configured to inform a change of the load detected by said load sensor with respect to time to the user in a real-time manner.

29. The leg training equipment as set forth in claim 1, comprising an input unit configured to input data of the user, a calculation unit configured to calculate an appropriate range of a pressure to be applied to said support portion by the user according to the data input from said input unit, a pressure sensor configured to detect a pressure actually applied to said support portion by the user, and a display unit configured to indicate the appropriate range provided by said calculation unit and the actual pressure value detected by said pressure sensor to the user.

30. The leg training equipment as set forth in claim 1, comprising an input unit configured to input data of the user, a calculation unit configured to calculate an appropriate range of a pressure to be applied to said support portion by the user according to the data input from said input unit, a pressure sensor configured to detect a pressure actually applied to said support portion by the user, and a control unit configured to control said coupling mechanism in a feedback manner such that the pressure value detected by said pressure sensor is kept within said appropriate range.

* * * * *